US007528691B2

(12) United States Patent
Wallis et al.

(10) Patent No.: US 7,528,691 B2
(45) Date of Patent: May 5, 2009

(54) DUAL SUBSTRATE ELECTROSTATIC MEMS SWITCH WITH HERMETIC SEAL AND METHOD OF MANUFACTURE

(75) Inventors: Andrew D. Wallis, Los Alamos, CA (US); John S. Foster, Santa Barbara, CA (US); Paul J. Rubel, Santa Barbara, CA (US); Kimon Rybnicek, Santa Barbara, CA (US); Michael J. Shillinger, Santa Ynez, CA (US); Jeffrey F. Summers, Santa Barbara, CA (US)

(73) Assignee: Innovative Micro Technology, Goleta, CA (US)

( * ) Notice: Subject to any disclaimer, the term of this patent is extended or adjusted under 35 U.S.C. 154(b) by 337 days.

(21) Appl. No.: 11/211,623

(22) Filed: Aug. 26, 2005

(65) Prior Publication Data

US 2007/0236313 A1 Oct. 11, 2007

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,278,368 A * 1/1994 Kasano et al. ..... 200/181
6,124,650 A * 9/2000 Bishop et al. ..... 335/78
6,384,353 B1 * 5/2002 Huang et al. ..... 200/181
6,486,425 B2 11/2002 Seki
6,511,894 B2 * 1/2003 Song ..... 438/455
6,580,138 B1 6/2003 Kubena et al.
6,624,003 B1 * 9/2003 Rice ..... 438/106
6,746,891 B2 6/2004 Cunningham et al.
6,818,464 B2 11/2004 Heschel
6,876,482 B2 4/2005 DeReus
6,903,637 B2 * 6/2005 Miyazaki et al. ..... 335/78
6,917,086 B2 7/2005 Cunningham et al.
2005/0206483 A1 9/2005 Pashby et al.
2007/0256917 A1 * 11/2007 Oberhammer et al. ..... 200/181

OTHER PUBLICATIONS

"RF MEMS and MEMS packaging," M. Hara, et al., Second International Symposium on Acoustic Wave Devices for Future Mobile Communications Systems, Thursday, Mar. 4, 2004, pp. 115-122.

"Copper Metallization of Semiconductor Interconnects—Issues and Prospets", Uziel Landau, Invited Talk, CMP, Symposium, Abstract # 505, Electrochemical Society Meeting, Phoenix, AZ, Oct. 22-27, 2000.

* cited by examiner

*Primary Examiner*—Lincoln Donovan
*Assistant Examiner*—Bernard Rojas
(74) *Attorney, Agent, or Firm*—Jaquelin K. Spong

(57) ABSTRACT

Systems and methods for forming an electrostatic MEMS switch include forming a cantilevered beam on a first substrate, forming the electrical contacts on a second substrate, and coupling the two substrates using a hermetic seal. The hermetic seal may be a gold/indium alloy, formed by heating a layer of indium plated over a layer of gold. Electrical access to the electrostatic MEMS switch may be made by forming vias through the thickness of the second substrate.

20 Claims, 24 Drawing Sheets

DUAL SUBSTRATE ELECTROSTATIC MEMS SWITCH WITH HERMETIC SEAL AND METHOD OF MANUFACTURE

CROSS REFERENCE TO RELATED APPLICATIONS

This U.S. patent application is related to U.S. patent application Ser. No. 11/211,625, U.S. patent application Ser. No. 11/211,622, U.S. patent application Ser. No. 11/211,624 filed on an even date herewith, each of which is incorporated by reference in its entirety.

STATEMENT REGAURDING FEDERALLY SPONSORED RESEARCH

Not applicable.

STATEMENT REGAURDING MICROFICHE APPENDIX

Not applicable.

BACKGROUND

This invention relates to an electrostatic microelectromechanical switch and its method of manufacture.

Microelectromechanical systems are devices often having moveable components which are manufactured using lithographic fabrication processes developed for producing semiconductor electronic devices. Because the manufacturing processes are lithographic, MEMS devices may be made in very small sizes. MEMS techniques have been used to manufacture a wide variety of sensors and actuators, such as accelerometers and electrostatic cantilevers.

MEMS techniques have also been used to manufacture electrical relays or switches of small size, generally using an electrostatic actuation means to activate the switch. MEMS devices often make use of silicon-on-insulator (SOI) wafers, which are a relatively thick silicon "handle" wafer with a thin silicon dioxide insulating layer, followed by a relatively thin silicon "device" layer. In the MEMS devices, a thin cantilevered beam of silicon is etched into the silicon device layer, and a cavity is created adjacent to the thin beam, typically by etching the thin silicon dioxide layer to allow for the electrostatic deflection of the beam Electrodes provided above or below the beam may provide the voltage potential which produces the attractive (or repulsive) force to the cantilevered beam, causing it to deflect within the cavity.

One known embodiment of such an electrostatic relay is disclosed in U.S. Pat. No. 6,486,425 to Seki. The electrostatic relay described in this patent includes a fixed substrate having a fixed terminal on its upper surface and a moveable substrate having a moveable terminal on its lower surface. Upon applying a voltage between the moveable electrode and the fixed electrode, the moveable substrate is attracted to the fixed substrate such that an electrode provided on the moveable substrate contacts another electrode provided on the fixed substrate to close the microrelay.

However, to fabricate the microrelay described in U.S. Pat. No. 6,486,425, the upper substrate must be moveable, so that the upper substrate must be thin enough such that the electrostatic force may cause it to deflect. The moveable substrate is formed from a silicon-on-insulator wafer, wherein the cantilevered beam is formed in the silicon device layer, and the SOI wafer is then adhered to the fixed substrate. The silicon handle wafer and silicon dioxide insulating layer are then removed from the SOI wafer, leaving only the thin silicon device layer which forms the moveable substrate.

SUMMARY

Because the top substrate of the microrelay is necessarily moveable, it is also susceptible to damage from contact during or after fabrication.

The systems and methods described here form an electrostatic MEMS switch using dual substrates, one on which to form the cantilevered beam with an electrical shunt beam to provide an electrical connection between two contacts of a switch, and the other on which to form the two contacts of the switch. In the systems and methods described here, the attachment point of the cantilevered beam remains fixed to the silicon dioxide and handle layer of the SOI substrate. A portion of the silicon dioxide layer adjacent to the cantilevered beam is etched to release the beam, however, a silicon dioxide attachment point remains which affixes the cantilevered beam to the silicon handle layer. The silicon dioxide layer therefore provides the cantilevered point of adhesion to the upper substrate, rather than being fixed by a support member to the lower, fixed substrate. Because the remainder of the rigid, SOI wafer remains intact, it may provide protection for the switch against inadvertent contact and shock.

Because the rigid SOI wafer remains intact, it may also be hermetically bonded to the second, lower substrate at the end of the fabrication process. By forming the hermetic seal, the switch may enclose a particular gas environment which may be chosen to increase the breakdown voltage of the gas environment within the switch. The hermetic seal may also protect the electrostatic MEMS switch from ambient dust and debris, which may otherwise interfere with the proper functioning of the device.

In one exemplary embodiment, the method for manufacturing the MEMS switch may include forming a cantilevered beam on a first substrate, forming at least one contact on a second substrate, and coupling the first substrate to the second substrate with a hermetic seal that encloses the MEMS switch. By forming these features on separate substrates, the cleanliness of the contact points may be maintained during processing, before the substrates are sealed hermetically.

The hermetic seal may be made by forming an alloy of gold and indium, $AuIn_2$ by melting a layer of indium deposited over a layer of gold. The hermetic seal is therefore also conductive, and may provide electrical access to the cantilevered beam, for example. The hermetic seal may be particularly important for switching applications involving relatively high voltage signals, wherein an insulating gas may be needed to prevent electrical breakdown of the air between the high voltage electrodes. In such cases, the insulating gas may need to be sealed hermetically to create an environment for the MEMS switch which can withstand higher voltages without breaking down, without allowing the gas to leak out of the MEMS switch seal.

In another exemplary embodiment, electrical access to the switch may be gained using through hole vias formed in the second, lower substrate. By providing electrical access through the lower substrate, the hermetic seal is not compromised by the presence of electrical leads being routed under the bond line.

The systems and methods described herein may be appropriate for the fabrication of an RF electrostatic MEMS switch which is capable of operating in the range of DC to 10 GHz.

These and other features and advantages are described in, or are apparent from, the following detailed description.

BRIEF DESCRIPTION OF THE DRAWINGS

Various exemplary details are described with reference to the following figures, wherein.

DETAILED DESCRIPTION

In the systems and methods described here, an electrostatic MEMS switch is fabricated on two substrates. A cantilevered beam carrying a shunt bar is formed on the first substrate, and the electrical contacts of the switch, which will be connected via the shunt bar on the cantilevered beam when the switch is closed, are formed on the other substrate. The two substratea are then sealed hermetically by a gold-indium seal. Electrical access to the switch is afforded by a set of through hole vias, which extend through the thickness of the second substrate. Although the systems and methods are described as forming the cantilevered beam first followed by the electrical contacts, it should be understood that this embodiment is exemplary only, and that the electrical contacts may be formed first, or in parallel with, the formation of the cantilevered beam.

Figure 1:
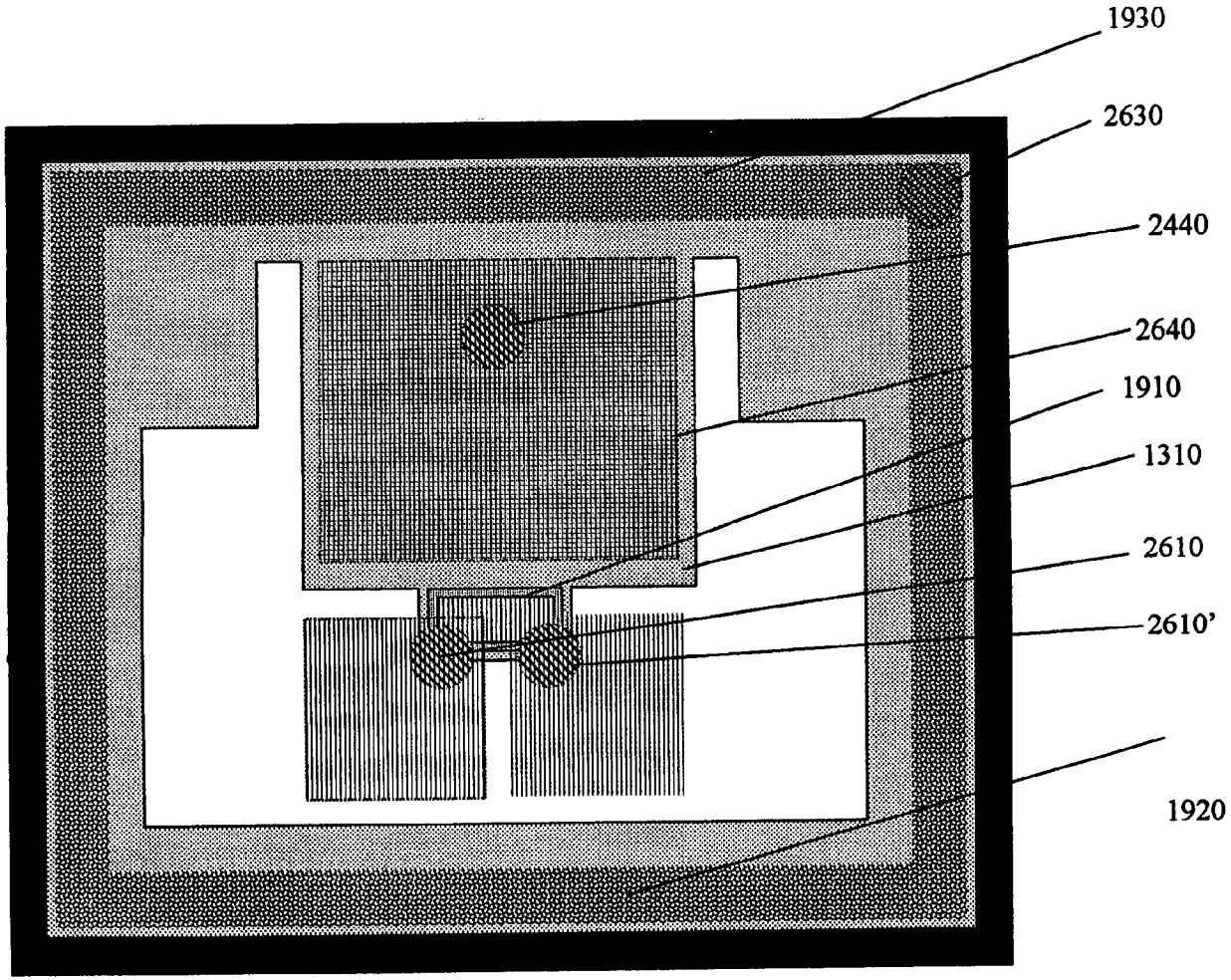
FIG. 1 is a plan view showing the dual substrate electrostatic MEMS switch with hermetic seal.

FIG. 1 is a plan view of the dual substrate electrostatic MEMS switch 100. The switch may include a cantilevered beam 1310 bearing a shunt bar 1910. The shunt bar is designed to span two contact points, 2610 and 2610'. Since the second of the two contact points 2610' lies directly behind the first contact point 2610, only the first contact point 2610 is shown in the following cross sectional diagrams. The cantilevered beam is actuated by an electrostatic plate 2640, which may be disposed directly beneath the cantilevered beam 1310. The cantilevered beam 1310 itself may form the adjacent plate of a parallel plate capacitor. When a differential voltage is placed on the cantilevered beam 1310 relative to the electrostatic plate 2640, the cantilevered beam is drawn toward the electrostatic plate 2640. The action lowers the shunt bar 1910 into a position where it contacts the contact points 2610 and 2610', thereby closing an electrical circuit.

Figure 2:
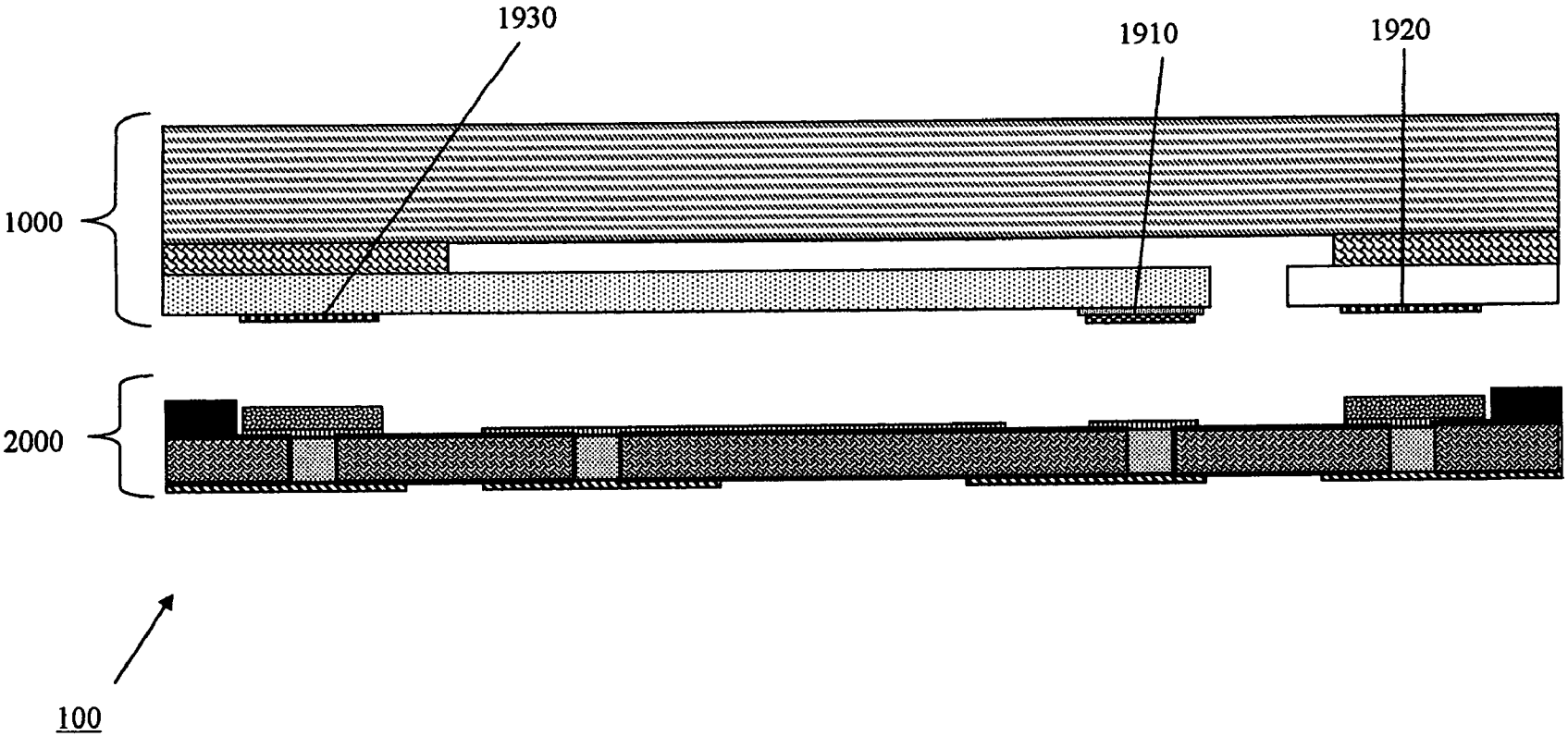
FIG. 2 is a cross sectional view showing the dual substrate electrostatic MEMS switch with hermetic seal.

FIG. 2 shows a cross section of the overall construction of the dual substrate electrostatic MEMS switch 100. The two components of the switch may be the cantilevered beam portion 1000 and the electrical contacts portion 2000. Fabrication of the electrostatic MEMS switch will be described first with respect to the cantilevered beam portion 1000, and thereafter with respect to-the electrical contacts portion 2000. FIGS. 2-15 depict the fabrication of the cantilevered beam portion 1000, and FIGS. 16-28 depict the fabrication of the electrical contacts portion 2000. FIGS. 29-38 depict the final processing steps of the dual substrate electrostatic MEMS switch 100.

Figure 3:
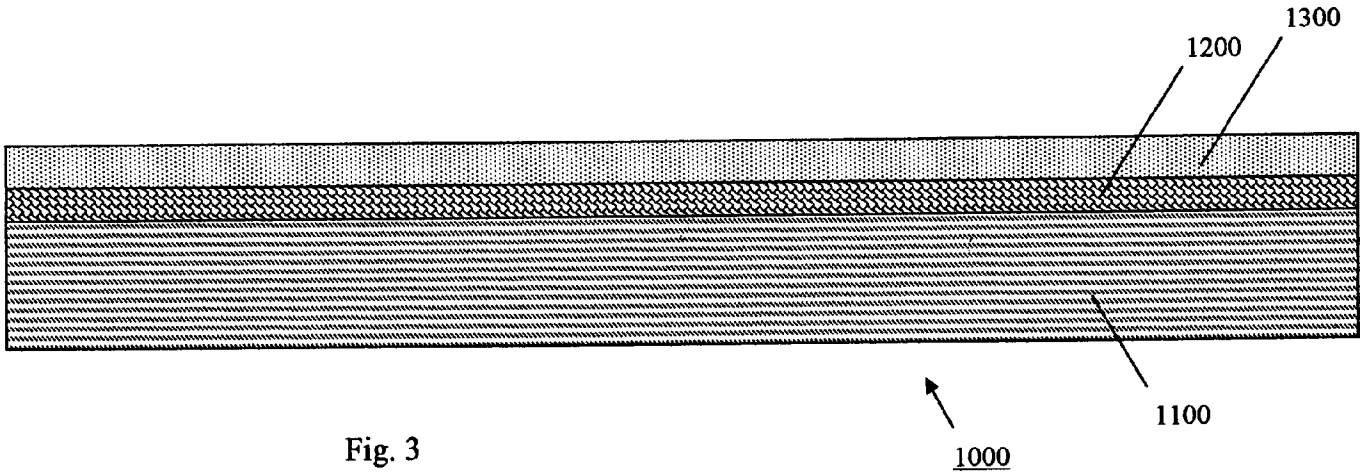
FIG. 3 is a cross sectional view of an exemplary substrate for forming the cantilever beam of the electrostatic MEMS switch.

FIG. 3 shows a cross section of an exemplary substrate 1000 for fabricating the cantilevered beam The substrate 1000 may be a silicon-on-insulator (SOI) substrate, well known in the art of MEMS processing. The SOI substrate may consist of a relatively thick "handle" wafer 1100, of a thickness of for example, 600 An, which may be made of silicon. A thin (about 2 μm) layer 1200 of insulator may cover the silicon handle wafer 1100. The thin insulating layer 1200 may be silicon dioxide, which is grown over or deposited on the silicon handle wafer 1100. On top of the silicon dioxide layer 1200 is another, thinner "device" layer 1300. The device layer 1300, like the handle wafer 1100, may be made of silicon. The silicon device layer 1300 may be, in this embodiment, about 5 μm thick. The device wafer 1300 may be fusion bonded, or otherwise adhered to the silicon dioxide layer 1200 and handle wafer 1100. In MEMS processing, the moveable features of the MEMS device are typically etched in the device layer 1300, using the silicon dioxide layer 1200 as a convenient etch stop.

Figure 4:
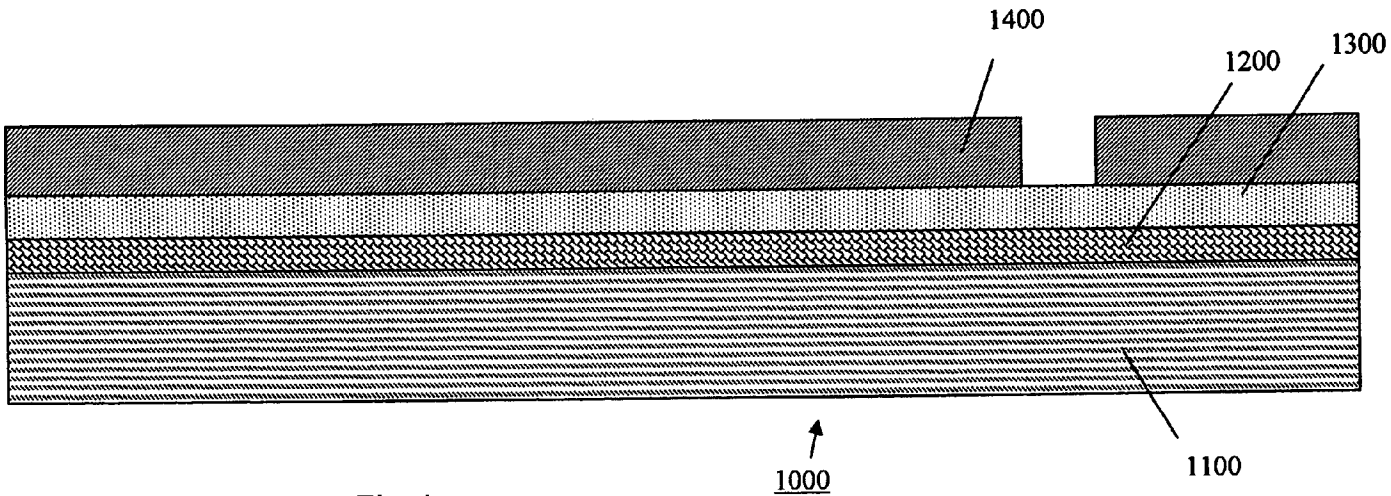
FIG. 4 is a cross sectional view of the exemplary substrate of FIG. 3 after deposition and patterning of photoresist.

FIG. 4 depicts a first step in fabricating the cantilevered beam portion 1000. In FIG. 4, photoresist is deposited over the device layer 1300, and exposed according to a pattern formed in a photolithographic mask. The exposed portions of the photoresist are dissolved and removed if a positive photoresist is used. If a negative photoresist is used, the unexposed regions are dissolved and removed. In the following description, it should be understood that either a positive or negative photoresist may be used. The areas in which the photoresist has been removed correspond to the outline of the cantilevered beam that will be formed in the device layer 1300.

Figure 5:
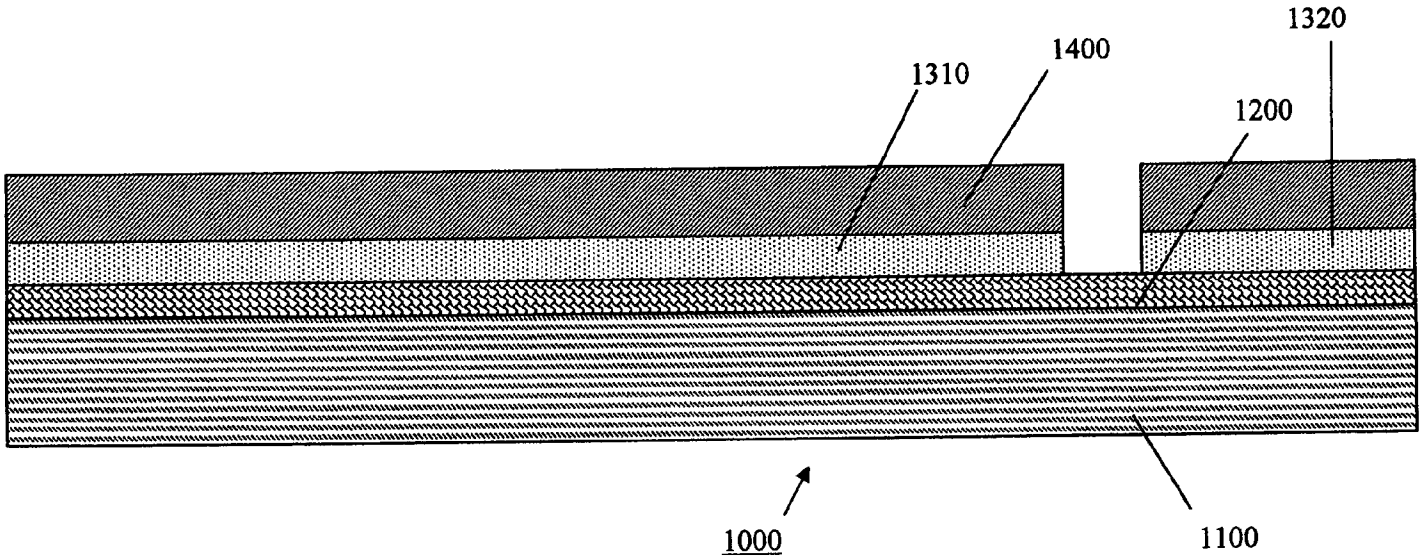
FIG. 5 is a cross sectional view of the exemplary substrate of FIG. 4 after etching the cantilever beam of the electrostatic MEMS switch.
Figure 6:
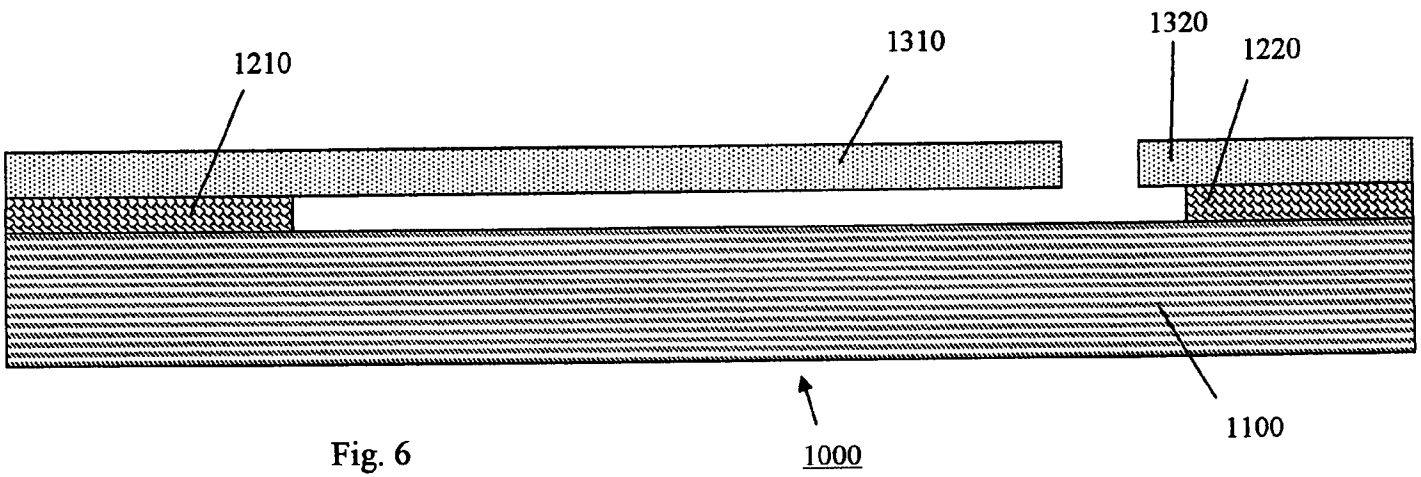
FIG. 6 is a cross sectional view of the exemplary substrate of FIG. 5 after releasing the cantilever beam.

The device is then etched as illustrated in FIG. 5. The etching techniques may be deep reactive ion etching (DRIE), which forms very steep, nearly vertical sidewalls through the device layer 1300. The deep reactive ion etching technique may also use an inductively coupled plasma source, such as the DRIE system manufactured by Surface Technology Systems of Newport, United Kingdom The DRIE process forms the outline of the cantilevered beam 1310 in the device layer 1300. Because the cantilevered beam 1310 is formed from the silicon device layer 1300, the thickness of the beam may be the thickness of the silicon device layer, about 5 μm. The length of the cantilevered beam 1310 may be about 200 to 300 μm from the edge of the substrate to the end of the cantilevered beam 1310.

The etching process may leave the cantilevered beam 1310 separated from the remaining portion of the device layer 1320. However, at this point the cantilevered beam is still attached to the handle wafer 1100 by the thin layer of silicon dioxide 1200.

The cantilevered beam 1310 may be released from the handle wafer 1100 by performing, for example, an etch to remove a portion of the underlying silicon dioxide layer 1200. The resulting structure after etching the silicon dioxide layer 1200 is shown in cross section in FIG. 6. One exemplary method for removing the silicon dioxide layer is to wet etch the silicon dioxide in a solution of hydrofluoric (HF) acid. The solution composition may be about 49% HF and water. The etch process may be used to dissolve the silicon dioxide relatively far back from the end of the cantilevered beam 1310 by providing additional through holes in the cantilevered beam 1310 to provide additional conduits for the etchant. For simplicity of depiction, these additional holes are not shown in FIG. 6.

Figure 7:
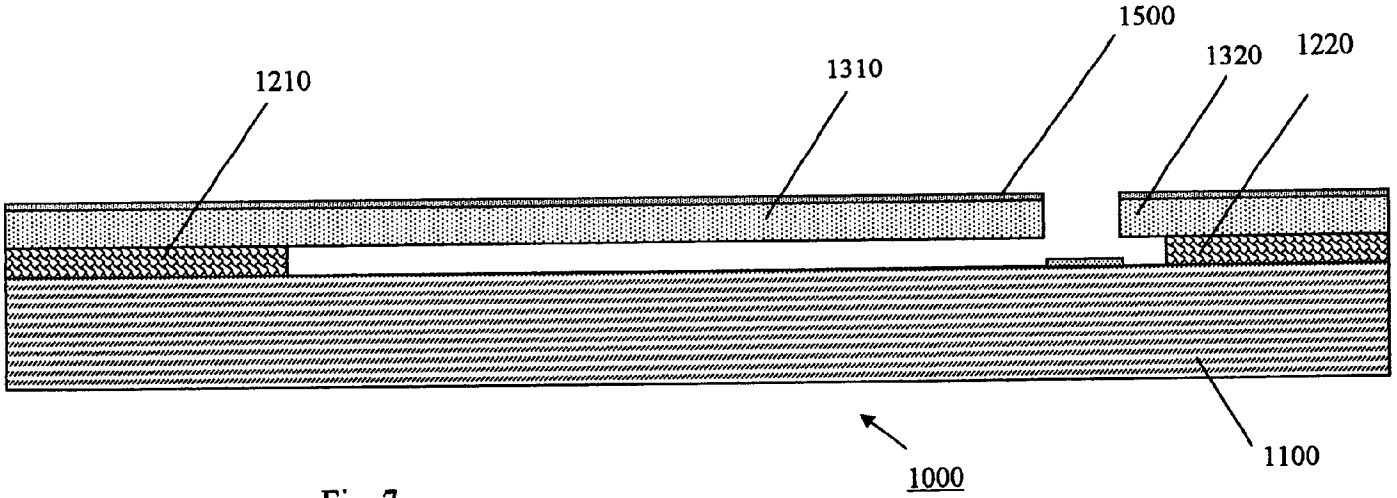
FIG. 7 is a cross sectional view of the exemplary substrate of FIG. 6 after deposition of an isolation layer.
Figure 8:
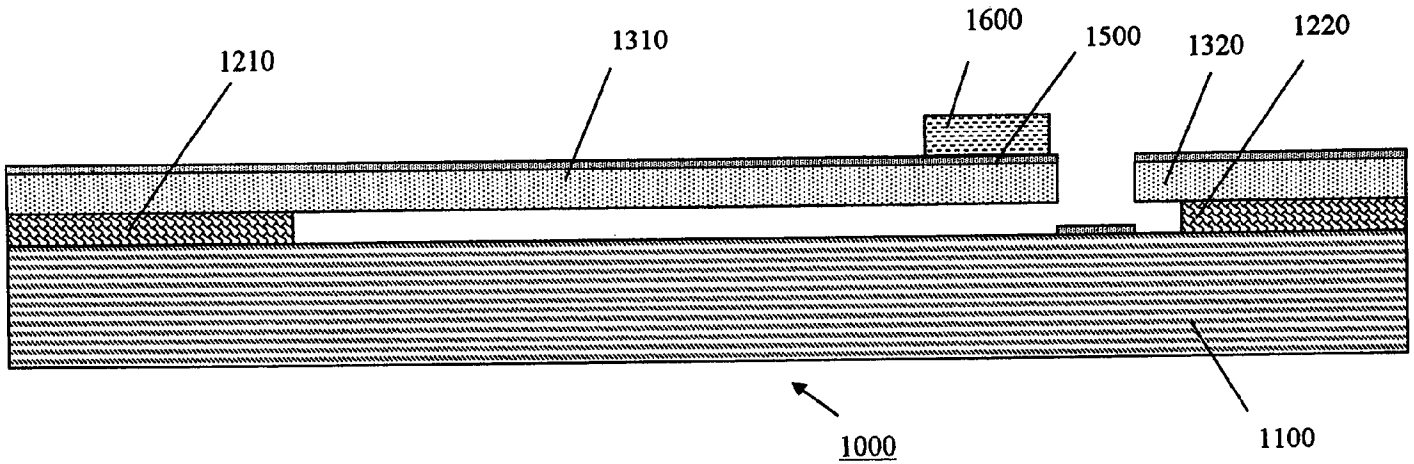
FIG. 8 is a cross sectional view of the exemplary substrate of FIG. 7 after deposition and patterning of photoresist.

The next step in the fabrication ofthe cantilevered portion 1000 is deposition of an oxide isolation layer 1500 on the cantilever. The isolation layer will electrically isolate the shunt bar 1910 from the cantilevered beam of silicon material 1310. FIG. 7 shows a cross section of the cantilevered beam portion 1000 after deposition of the isolation layer 1500. As shown in FIG. 7, the isolation layer 1500 ray be deposited over the entire surface, including the gap between the silicon cantilevered beam 1310 and the remaining portions of silicon 1320. In various exemplary embodiments, the isolation layer may be silicon dioxide, and may be, for example, about 2000 Angstroms thick. The oxide may be deposited in an oxidation furnace or by sputtering, for example.

Figure 9:
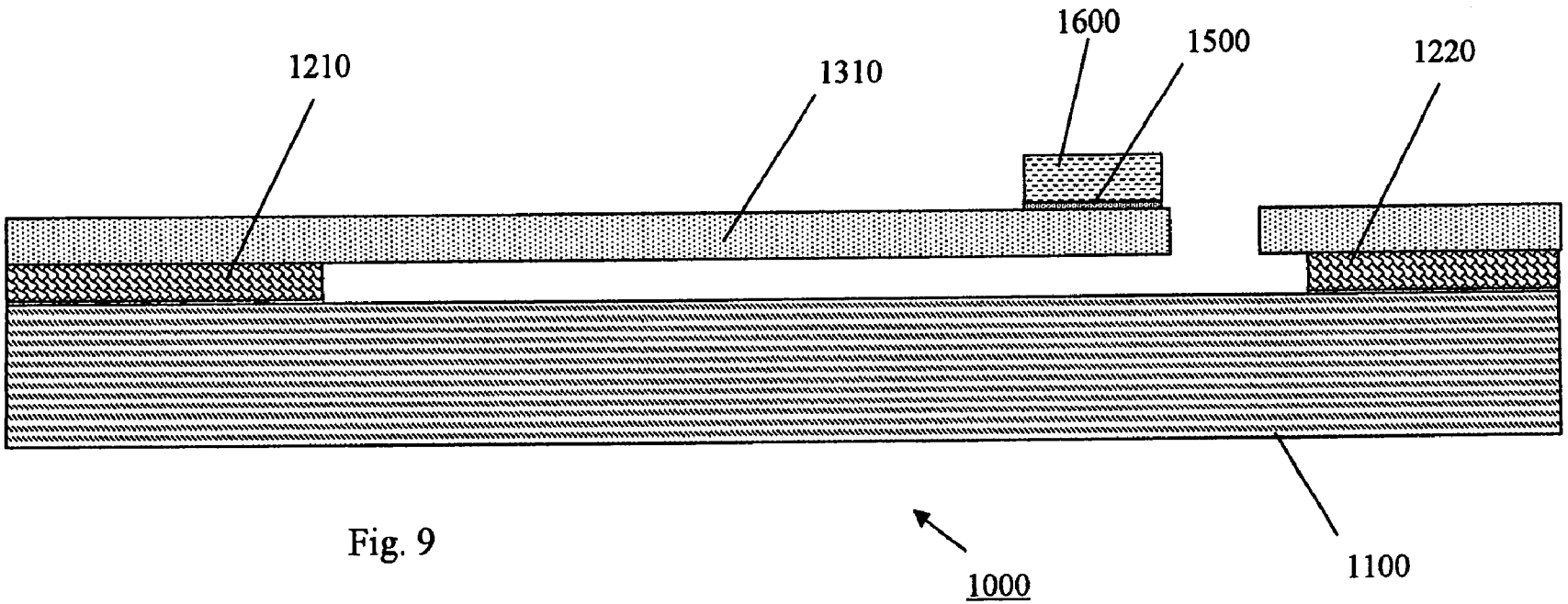
FIG. 9 is a cross sectional view of the exemplary substrate of FIG. 8 after etching the isolation layer.

The next step in the fabrication of the cantilevered portion 1000 is the removal of the silicon dioxide isolation layer 1500 everywhere but in the location of the shunt bar 1910. As depicted in the cross section of FIG. 8, the thin isolation layer 1500 is first covered with photoresist 1600 which is patterned and developed so that the photoresist 1600 covers only the region that will contain the shunt bar 1910. The oxide isolation layer 1500 is then removed everywhere not covered by photoresist 1600, as shown in FIG. 9. The oxide may be removed by, for example, reactive ion etching (RIE). This process also removes the silicon dioxide isolation layer 1500 which was deposited between the silicon cantilevered beam 1310 and the remaining silicon 1320.

Figure 10:
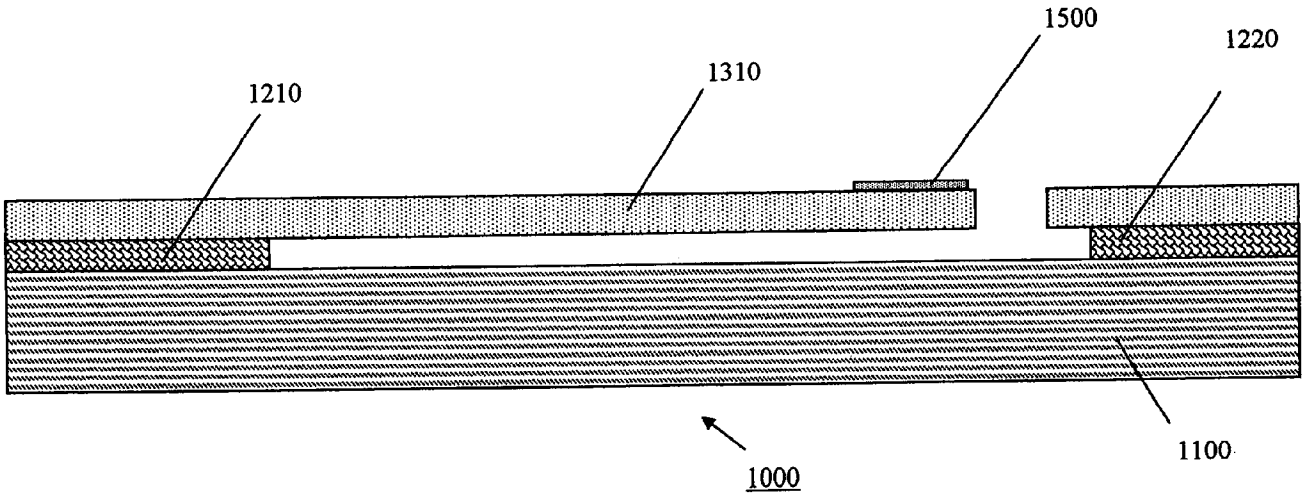
FIG. 10 is a cross sectional view of the exemplary substrate of FIG. 9 after removal of the photoresist.

The photoresist 1600 used to form the isolation layer 1500 is then stripped, leaving the cantilevered beam portion 1000 in the condition shown in FIG. 10. The process then proceeds with the steps needed to form the shunt bar 1910. The shunt bar 1910 may be formed by a liftoff procedure described next.

Figure 11:
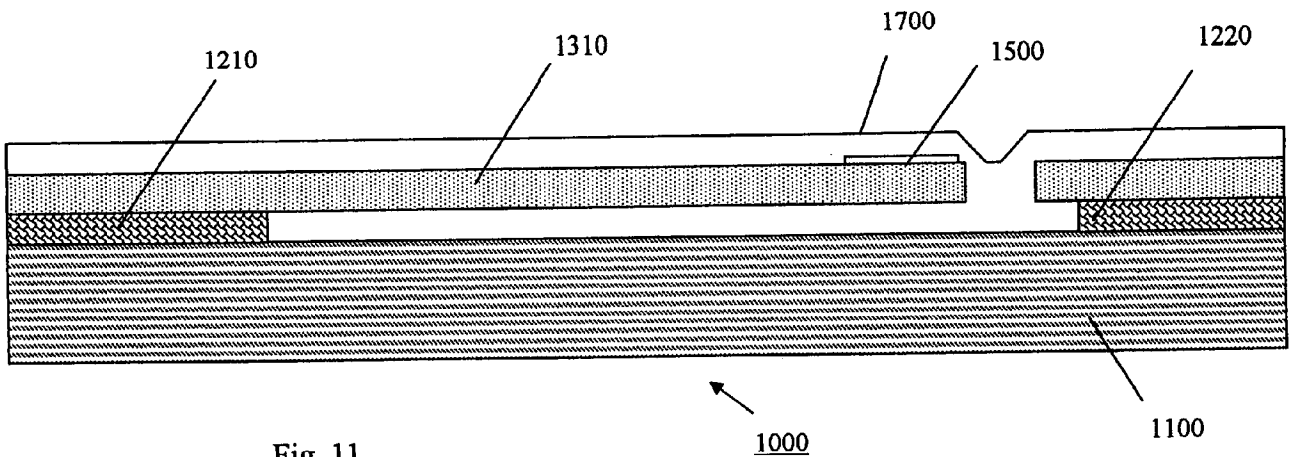
FIG. 11 is a cross sectional view of the exemplary substrate of FIG. 10 after deposition of a liftoff layer.

The first step in the lift off procedure is the deposition of an anchoring layer of polyimide 1700, as shown in FIG. 11. The purpose of the anchoring layer of polyimide 1700 is to anchor the previously released cantilevered beam 1310, and protect it during a lift off procedure which may include an ultrasonic treatment. The ultrasonic treatment may be used later to selectively dissolve photoresist and lift off a metal layer which will be deposited to form the shunt bar 1910.

Figure 12:
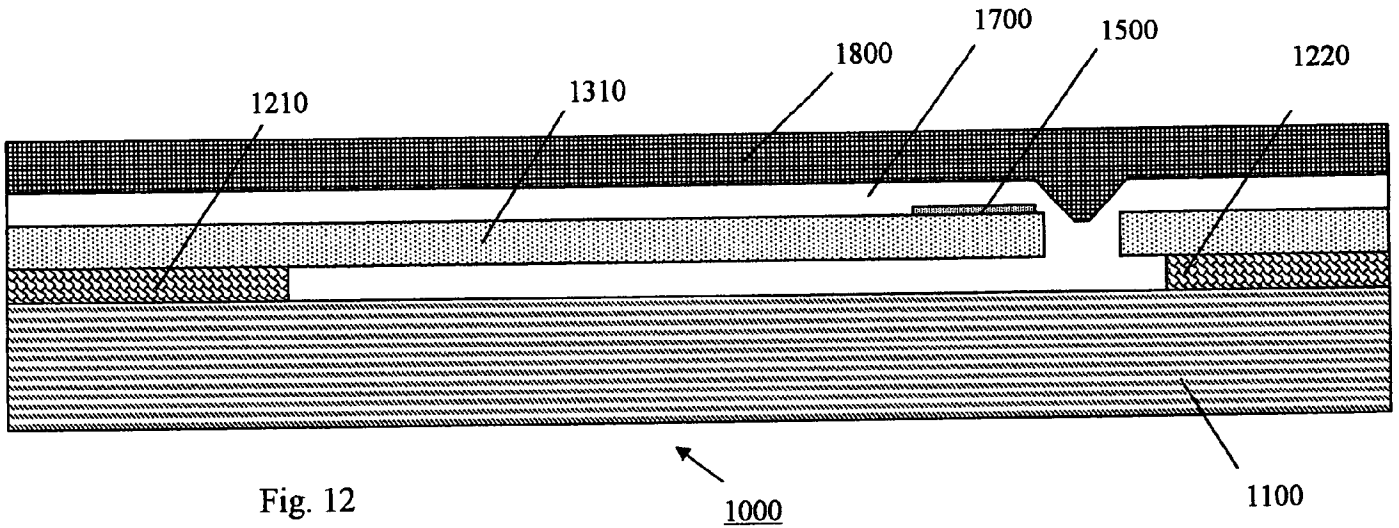
FIG. 12 is a cross sectional view of the exemplary substrate of FIG. 11 after deposition of a photoresist layer.
Figure 13:
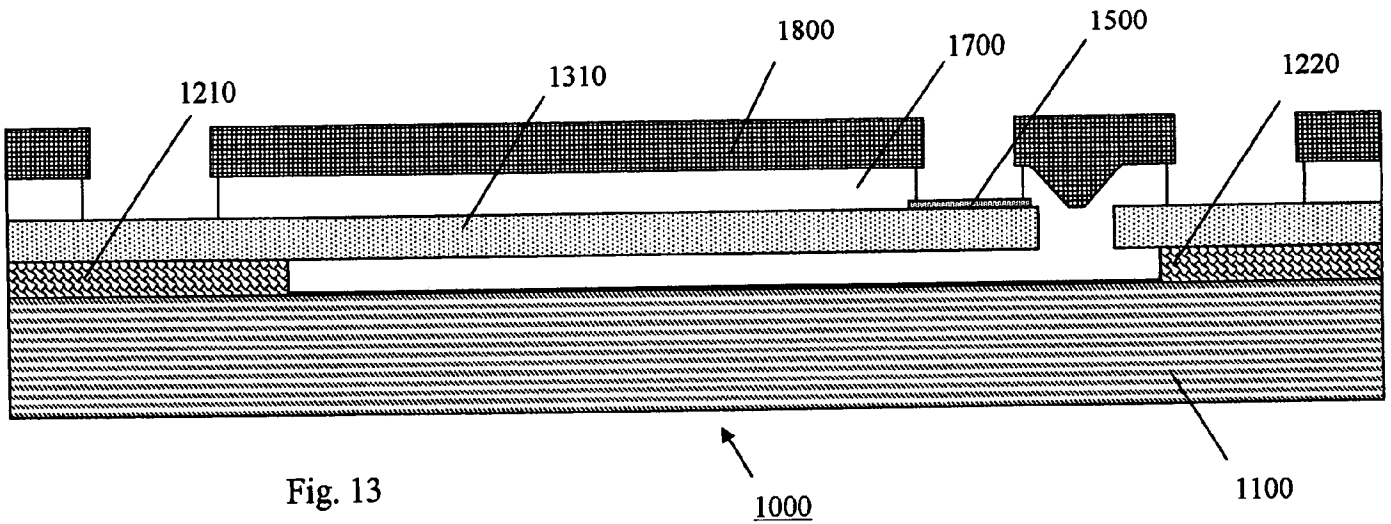
FIG. 13 is a cross sectional view of the exemplary substrate of FIG. 12 after patterning of the liftoff and photoresist layers.

Photoresist 1800 may then be deposited over the polyimide 1700, as shown in FIG. 12. The photoresist 1800 and polyimide 1700 are then patterned as shown in FIG. 13. This pattening will create the features of the shunt bar 1910, and also the metallization layers 1920 and 1930 which will participate in the bonding of the cantilevered beam portion 1000 with the electrical contacts portion 2000 of the dual substrate electrostatic MEMS switch 100. One helpful feature of the developer soluble polyimide 1700 is that it undercuts slightly the photoresist 1800, creating a slight overhang of the photoresist 1800 over the polyimide 1700. This may help assure a clean lift off of the metal layer which will be deposited over the patterned surface.

Figure 14:
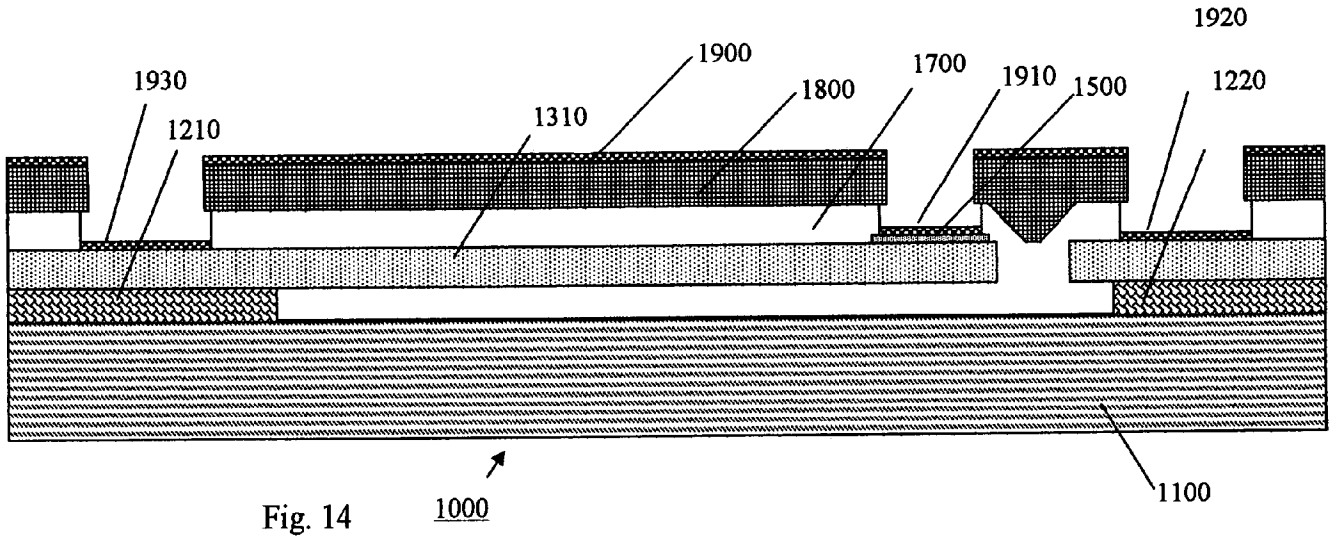
FIG. 14 is a cross sectional view of the exemplary substrate of FIG. 13 after deposition of the shunt bar and contacts.

FIG. 14 shows the deposition of the metallization layer 1900. The metallization layer 1900 may actually be a multilayer comprising first a thin layer of chromium (Cr) for adhesion to the silicon and silicon dioxide surfaces. The Cr layer may be from about 50 Angstroms to about 100 Angstroms in thickness. The Cr layer may be followed by a 100 Angstrom thick layer of molybdenum (Mo), and finally a thicker layer about 3000 Angstroms to about 5000 Angstroms of gold (Au) as the conductive metallization layer. The purpose of the Mo layer is to be a diffusion barrier between the Cr and the Au, preventing the diffusion of Cr into the Au, which would otherwise dramatically increase the resistance of the Au.

Each of the Cr. Mo and Au layers may be sputter-deposited using, for example, an ion beam deposition chamber (IBD). In an IBD chamber, the three targets, Cr, Mo and Au may be rotated into position to deposit the multilayer films without breaking the vacuum. The metallization multilayer 1900 may be deposited in the region corresponding to the shunt bar 1910, and also the regions which will correspond to the bond line between the cantilevered portion 1000 and the electrical contacts portion 2000 of the dual substrate electrostatic MEMS switch 100. These bond line areas 1920 and 1930 of metallization will form, with a layer of indium, a seal which will hermetically seal the cantilevered portion 1000 with the electrical contacts portion 2000, as will be described further below.

While a Cr/Mo/Au multilayer is disclosed as being usable for the metallization layer 1900 of the shunt bar 1910, it should be understood that this multilayer is exemplary only, and that any other choice of conductive materials or multilayers having suitable electronic transport properties may be used in place of the Cr/Mo/Au multilayer disclosed here. For example, for simple low temperature applications, the molybdenum layer may be omitted. Other materials, such as titanium (Ti) may be used as an adhesion layer between the Si and the Au. Other exotic materials, such as ruthenium (Ru) can be deposited on top of the Au to improve the switch contact properties, etc. However, the choice described above may be advantageous in that it can also participate in the sealing of the device through the alloy bond, as will be described more fully below.

Figure 15:
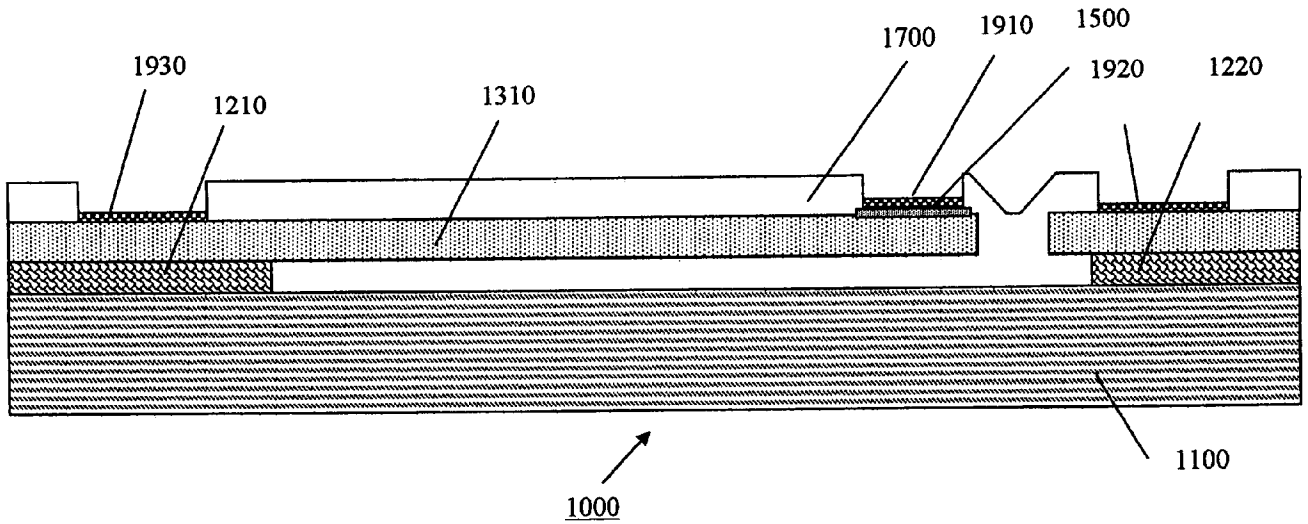
FIG. 15 is a cross sectional view of the exemplary substrate of FIG. 14 after removal of the photoresist layer and overlying metal.

FIG. 15 shows the cantilevered portion 1000 of the dual substrate electrostatic MEMS switch 100 after the photoresist layer 1800 has been lifted off The liftoff may be achieved by immersing the substrate in acetone in an ultrasonic bath, as mentioned previously. The polyimide layer 1700 does not dissolve in acetone, and therefore remains after the ultrasonic lift off. The lift off also removes all portions of the metallization layer 1900 which are deposited over the photoresist 1800, except for the shunt bar 1910, and the bond line portions 1920 and 1930, which are instead deposited directly on the silicon dioxide isolation layer 1500 and the silicon device layer 1300, respectively.

Figure 16:
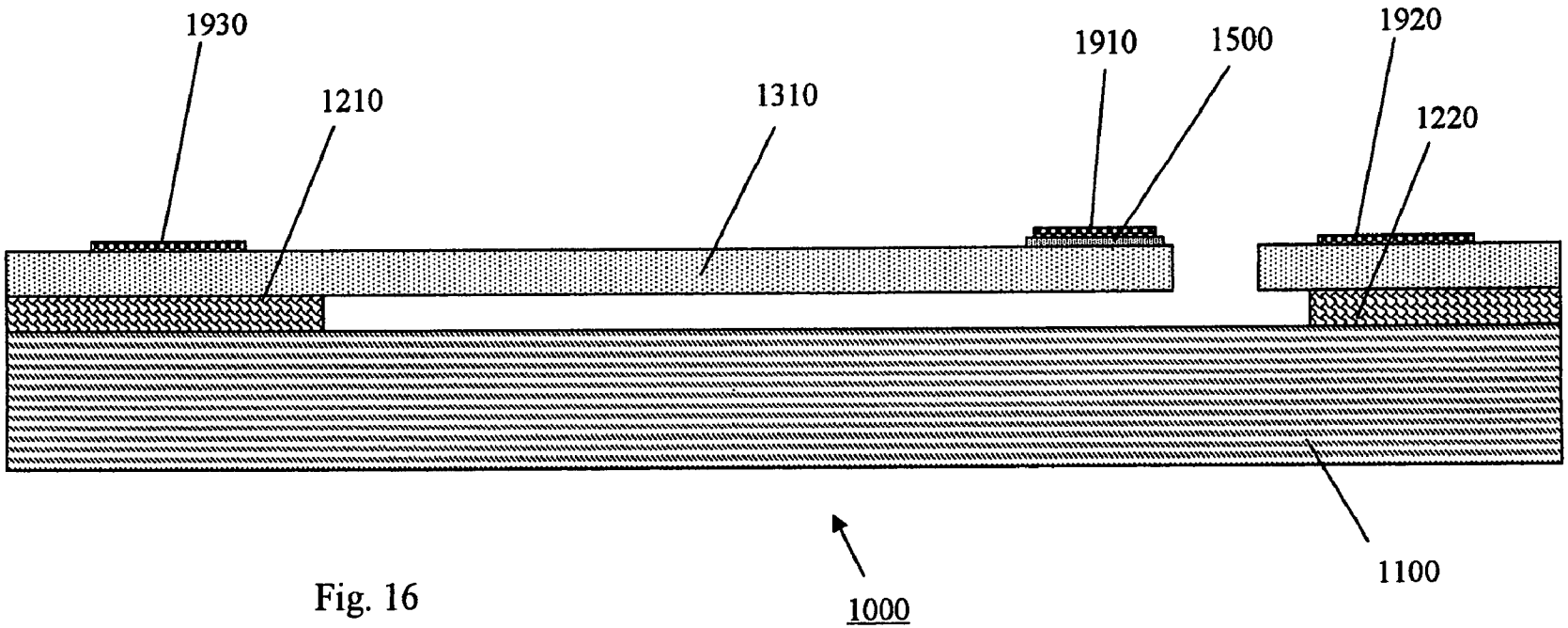
FIG. 16 is a cross sectional view of the finished cantilever beam on the first substrate.

The lift off of photoresist layer 1800 leaves only the layer of polyimide 1700, as shown in FIG. 15. The polyimide layer 1700 may then be removed by applying an aggressive polymer stripper, such as N-methylperrolidone. This removes the layer of polyimide 1700 and completes the fabrication of the cantilevered portion 1000 of the dual substrate electrostatic MEMS switch 100. The finished cantilevered portion 1000 is shown in FIG. 16. The cantilevered portion ray now include the cantilevered silicon beam 1310, the shunt bar 1910, the isolation layer 1500, the bond area metallizations 1920 and 1930, and the silicon dioxide region 1220 which adhere the cantilevered beam 1310 to the handle wafer 1100.

The description now turns to the fabrication of the electrical contacts portion 2000.

Figure 17:
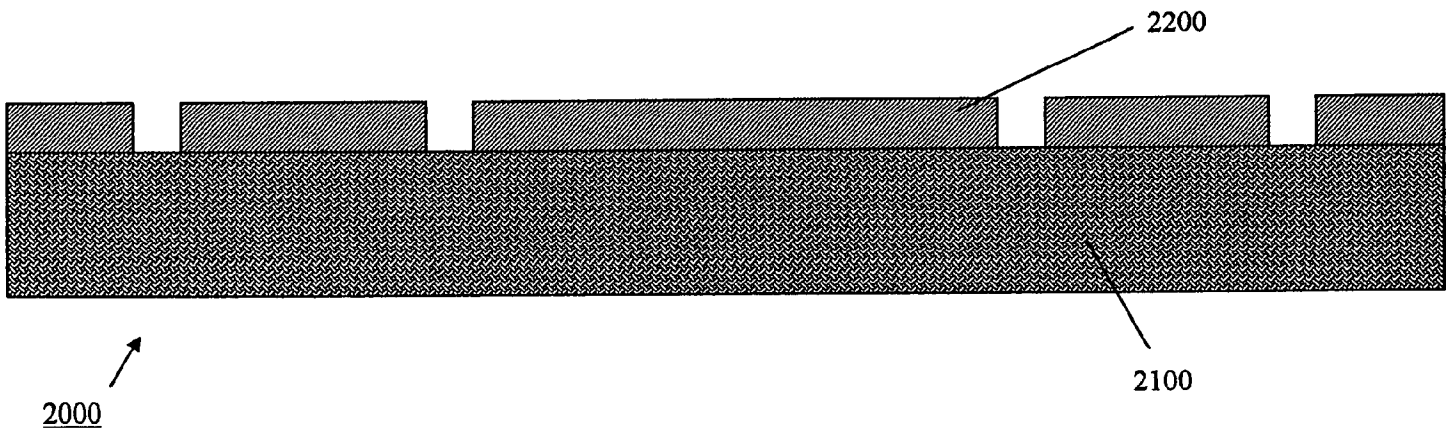
FIG. 17 is a cross sectional view of a second exemplary substrate covered with a patterned photoresist.

FIG. 17 shows a substrate 2100 suitable for fabricating the electrical contacts portion 2000 of the dual substrate electrostatic MEMS switch 100. The substrate 2100 may be, for example, silicon, glass, or any other suitable material consistent with the process described below, or suitable equivalent steps. The substrate 2100 is covered with a photoresist 2200, which is patterned in areas corresponding to the locations of vias, or electrical conduits that will be formed in the substrate 2100.

Figure 18:
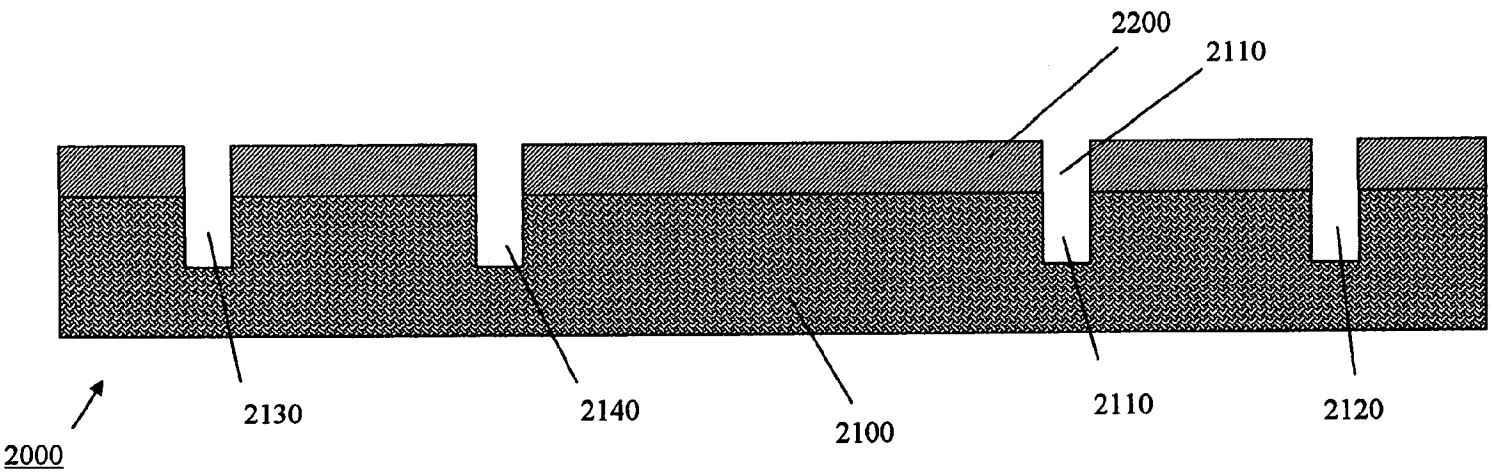
FIG. 18 illustrates the exemplary substrate of FIG. 17 after etching of vias.

Blind trenches may then be etched in the substrate 2100, as shown in FIG. 18, for the formation of a set of vias 2410-2440 which will be formed in the trenches 2110-2140 by plating copper into the trenches. The etching process may be reactive ion etching (RIE) or deep reactive ion etching (DRIE), for example, which may form blind trenches, each with a dead-end wall. Via 2130 may provide electrical access to the cantilevered beam 1310, and provide a voltage for one side of the parallel plate capacitor which may provide the electrostatic force required to close the switch; via 2140 may provide electrical access to an electrostatic plate which forms the other side of the parallel plate capacitor; via 2110 may provide electrical access to one of the contact points (another via provides electrical access to the second electrical contact point, located directly behind the first, and therefore, not shown in FIG. 18); via 2120 may be a redundant electrical connection to the device layer of the SOI wafer, which provides an additional ground path Many of these grounds vias may be incorporated along the bond line, but only one is shown here.

Figure 19:
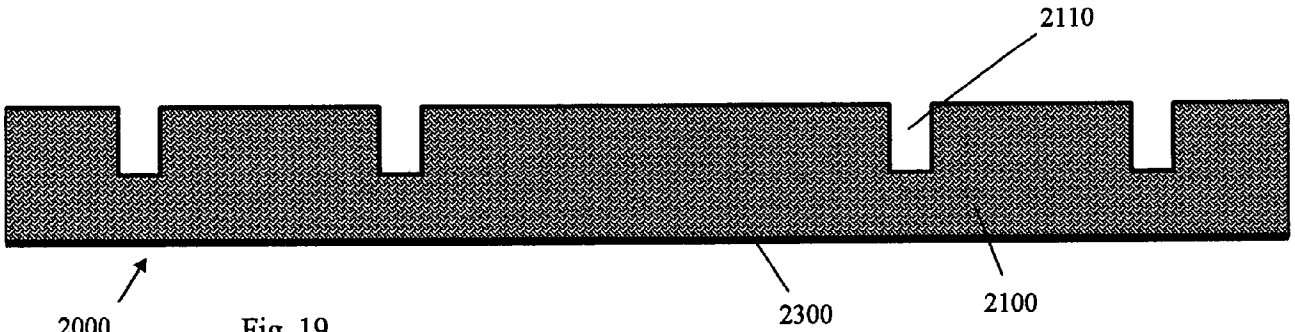
FIG. 19 is a cross sectional view of the exemplary substrate of FIG. 18 after oxidation of the substrate.
Figure 20:
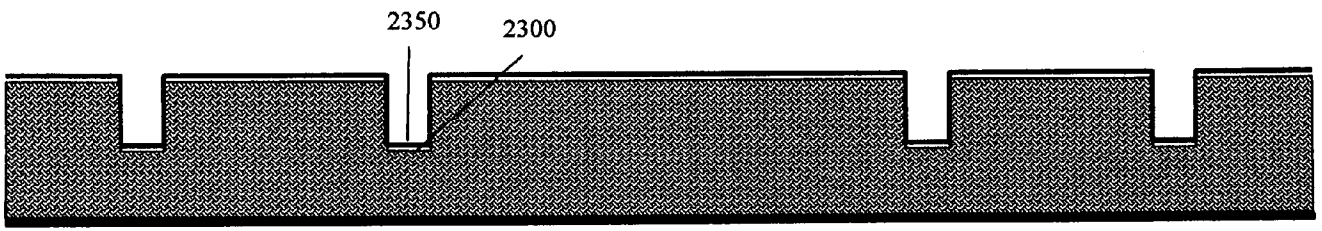
FIG. 20 is a cross sectional view of the exemplary substrate of FIG. 19 after deposition of a seed layer.

The substrate 2100 may then be allowed to oxidize thermally, to form a layer of silicon dioxide 2300, which electrically isolates one via from the next, as shown in FIG. 19. In addition, a seed layer 2350 may be deposited on the upper surface of substrate 2100, as shown in FIG. 20. The seed layer 2350 may be, for example, a thin layer of chromium followed by a thin layer of gold, the chromium for adhesion and the gold as a seed layer for the copper which will be plated into the vias The chromium/gold seed layer 2350 may be, for example, about 5000 Angstroms in thickness, and may be deposited by, for example, ion beam deposition (IBD), at one or multiple angles sufficient to provide an electrically continuous film of plating base to the bottom of the vias. Metals, such as Cu, may also be deposited using chemical vapor deposition (CVD) methods, so long as the metal is a compatible seed layer for the metal to be subsequently plated.

In order to promote "bottom-up" plating, the seed layer 2350 may be covered with an inhibition layer (not shown), to provide a "partially exposed" seed layer, as described in more detail in co-pending U.S. patent application Ser. No. 11/211,624, incorporated by reference herein in its entirety. The inhibition layer may cover all but the dead-end wall of the seed layer 2350 in the blind hole, such that plating begins at the bottom of the blind hole first and then continues upward to the top. The inhibition layer may be formed by sputter-depositing a layer of material from a target onto a tilted substrate, such that the angle of tilt causes the rim of the via to effectively shadow the dead-end wall, and the sputtered material is not deposited there.

Figure 21:
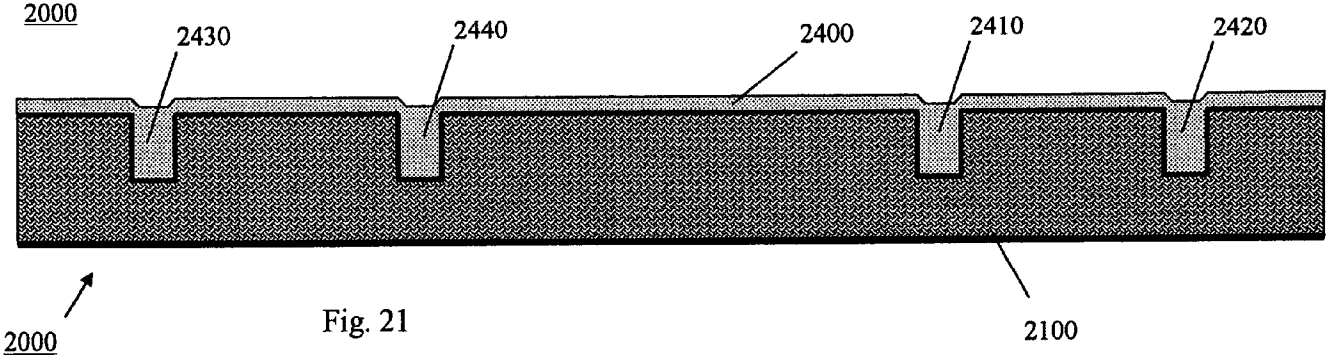
FIG. 21 is a cross sectional view of the exemplary substrate of FIG. 20 after plating of the vias.
Figure 22:
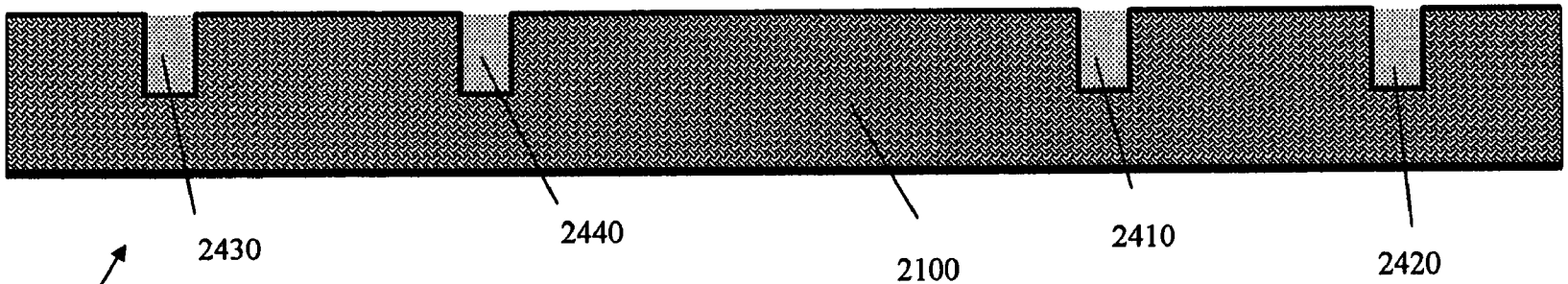
FIG. 22 is a cross sectional view of the exemplary substrate of FIG. 21 after chemical mechanical planarization.

The blind trenches 2110-2140 may then be plated with copper, for example, or any other suitable conductive material that can be plated into the blind trenches, such as gold (Au) or nickel (Ni), to create vias 2410-2440. To assure a complete fill, the plating process may be performed until the plated material fills the blind trenches to a point up and over the surface of the substrate 2100, as shown in FIG. 21. The upper surface of the substrate 2100 may then be planarized, using, for example, chemical mechanical planarization, until the plated vias 2410-2440 are flush with the surface of the substrate 2100, as shown in FIG. 22. The planarization process may stop on the inhibition layer of the substrate, leaving for example, about 1 μm of the previously deposited inhibition layer, further providing electrical isolation between the interior metal structures of the devices, which would otherwise be electrically connected by the silicon substrate.

Figure 23:
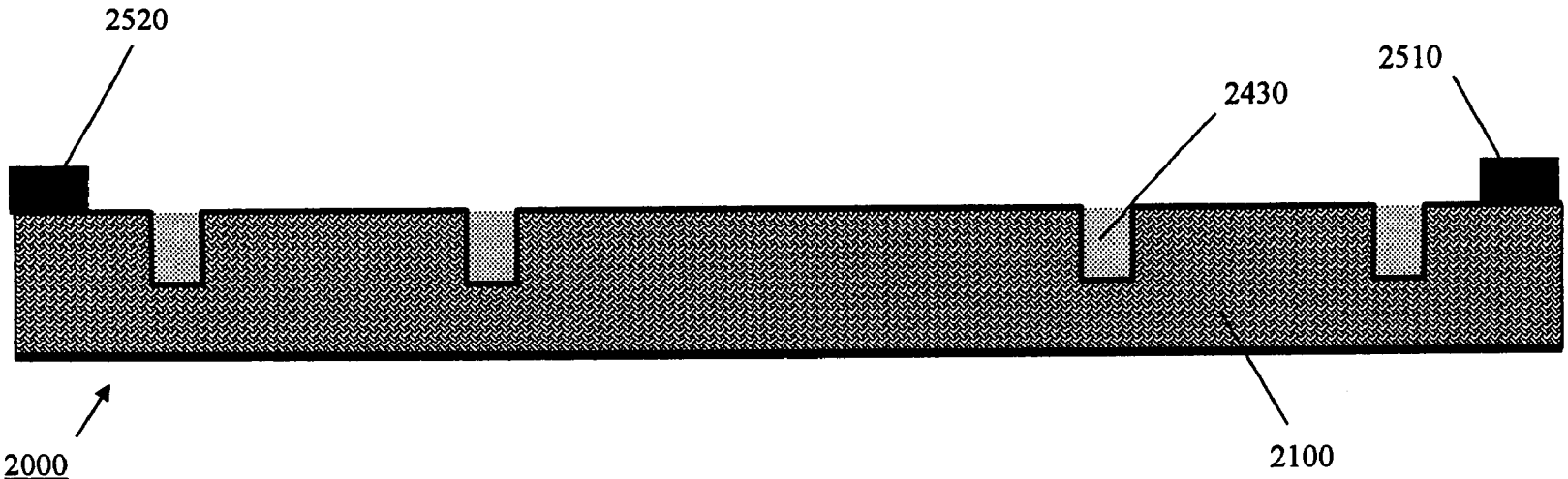
FIG. 23 is a cross sectional view of the exemplary substrate of FIG. 22 after deposition of the polymer spacers.

A pair of standoffs 2510 and 2520 may then be formed on the substrate 2100, as shown in FIG. 23. These standoffs may determine the separation between the substrate bearing the cantilevered beam portion 1000 and the substrate bearing the electrical contacts portion 2000, when the two substrates are bonded together. Any rigid material may be used, which is capable of forming a stiff standoff In one convenient embodiment, a polymer such as photoresist is patterned and cured for use as standoffs 2510 and 2520.

Figure 24:
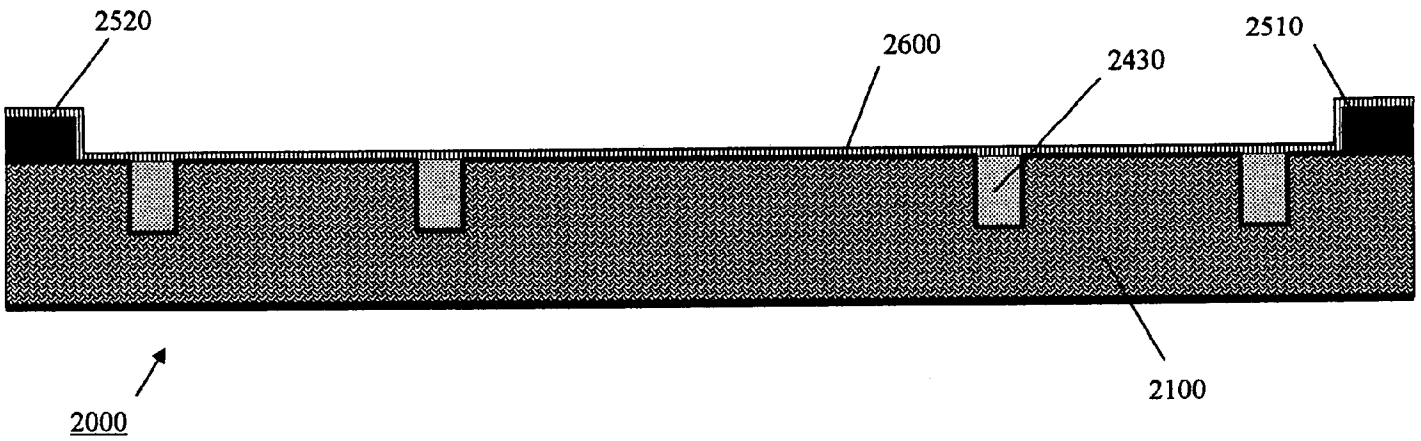
FIG. 24 is a cross sectional view of the exemplary substrate of FIG. 23 after deposition of a seed layer.

Another metallization layer 2600 is then deposited over the substrate 2100, as shown in FIG. 24. In one exemplary embodiment, the metallization layer 2600 may actually be a multilayer of Cr/Mo/Au, the same multilayer as was used for the metallization layer 1900 on the substrate 1100 of the cantilevered beam portion 1000 of the dual substrate electrostatic MEMS switch 100. The metallization multilayer 2600 may have similar thicknesses and may be deposited using a similar process as that used to deposit metallization layer 1900 on substrate 1100. The metallization layer 2600 may also serve as a seed layer for the deposition of indium, as described below.

Although metallization layer 2600 is described as consisting of a thin adhesion layer of Cr, and an antidiffusion layer of Mo, followed by a relatively thick layer of Au, it should be understood that this embodiment is exemplary only, and that any material having acceptable electrical transport characteristics may be used as metallization layer 2600. In particular, additional exotic materials may be deposited over the gold, to achieve particular contact properties, such as low contact resistance and improved wear.

Figure 25:
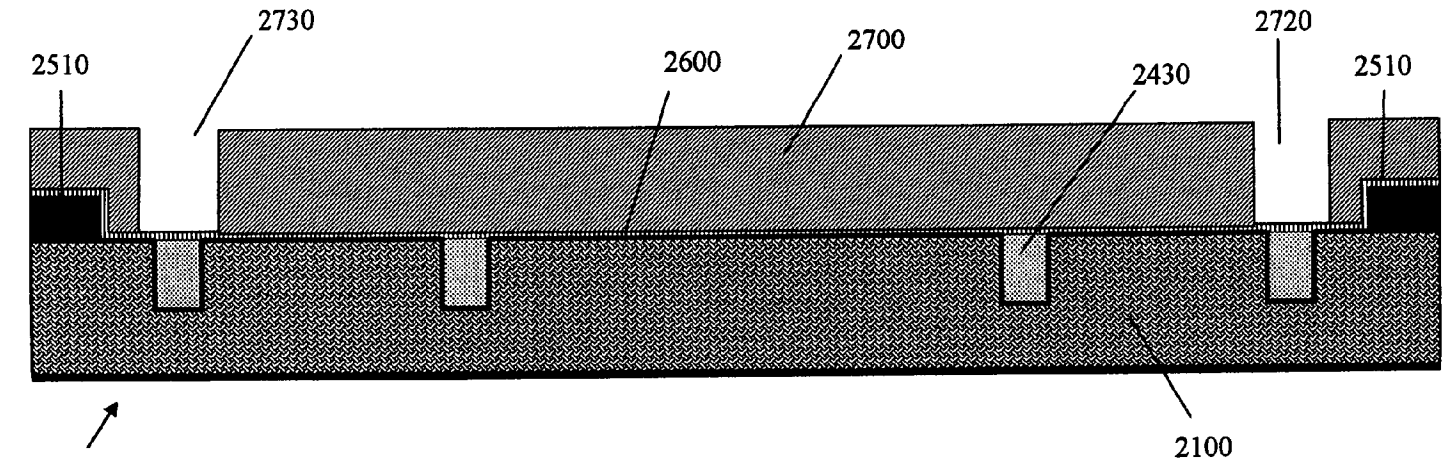
FIG. 25 is a cross sectional view of the exemplary substrate of FIG. 24 after deposition of photoresist.

As illustrated in FIG. 25, photoresist 2700 may then be deposited on metallization layer 2600, and patterned to provide features 2720 and 2730 for the plating of an indium layer. The indium layer will, along with the Au layer, form a hermetic seal that will bond the cantilevered portion 1000 to the electrical contacts portion 2000 of dual substrate electrostatic MEMS switch 100. The photoresist is exposed and developed to produce regions 2710 and 2720.

Figure 26:
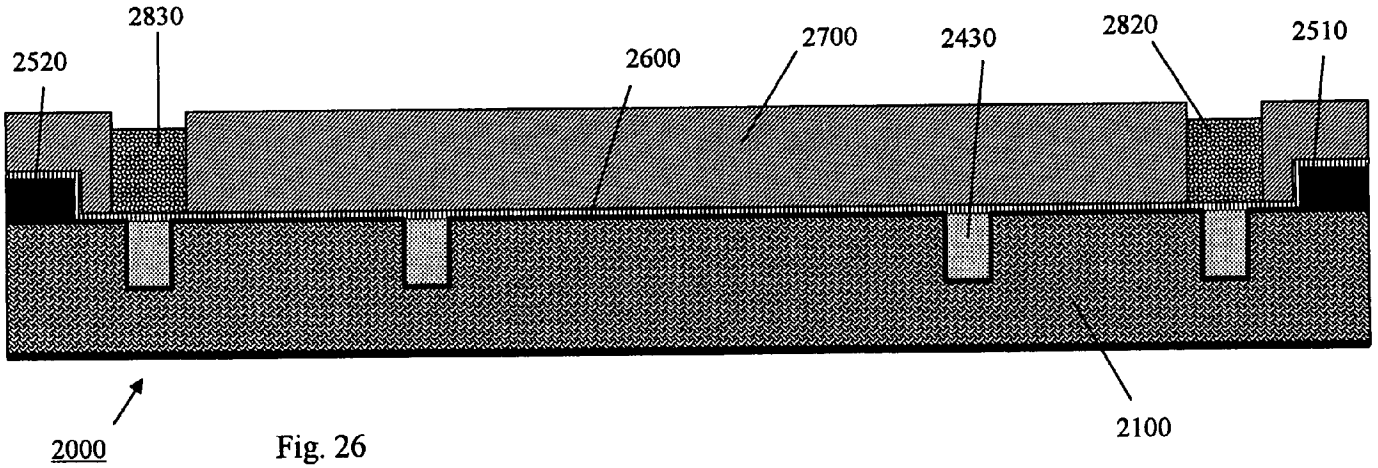
FIG. 26 is a cross sectional view of the exemplary substrate of FIG. 25 after plating of the indium for the alloy bond.

The substrate 2100 with photoresist layer 2700 may then be immersed in an indium plating bath, such that indium layers 2820 and 2830 are plated in features 2720 and 2730, respectively, as shown in FIG. 26. The thickness of the plated indium layer may be, for example, about 3 μm to about 6 μm It may be important to control the relative thickness (and therefore volume) of the indium compared to the thickness of the Au in metallization layer 2600, such that the ratio of materials may be appropriate to form a esthetic alloy of stoichiometry $AuIn_2$. Since the molar volume of indium is about 50% greater than gold, a combined gold thickness of both wafers of about 8000 Angstroms to about 10000 Angstroms may be approximately correct to form the $AuIn_2$ alloy. It may also be important to provide sufficient gold thickness that a thin layer of gold remains on the surface of the substrate 2100 to provide good adhesion to the substrate, after the formation of the gold/indium alloy. This can additionally be ensured by plating the indium layer narrower than the gold metallization layers, such that the final volumes and ratio of gold/indium provides for a slight excess of gold at the substrate interface.

Figure 27:
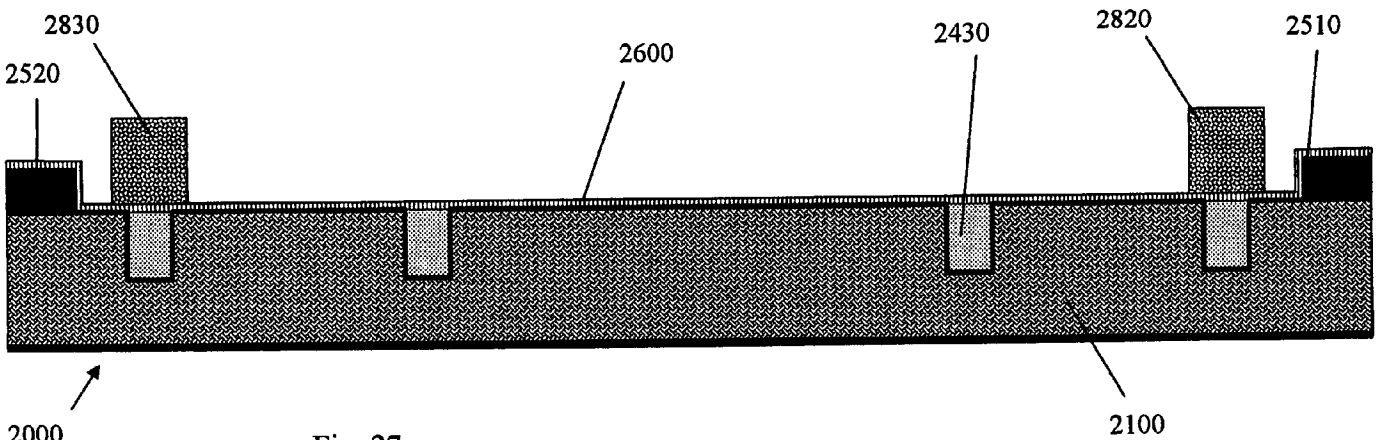
FIG. 27 is a cross sectional view of the exemplary substrate of FIG. 26 after removal of the photoresist.
Figure 28:
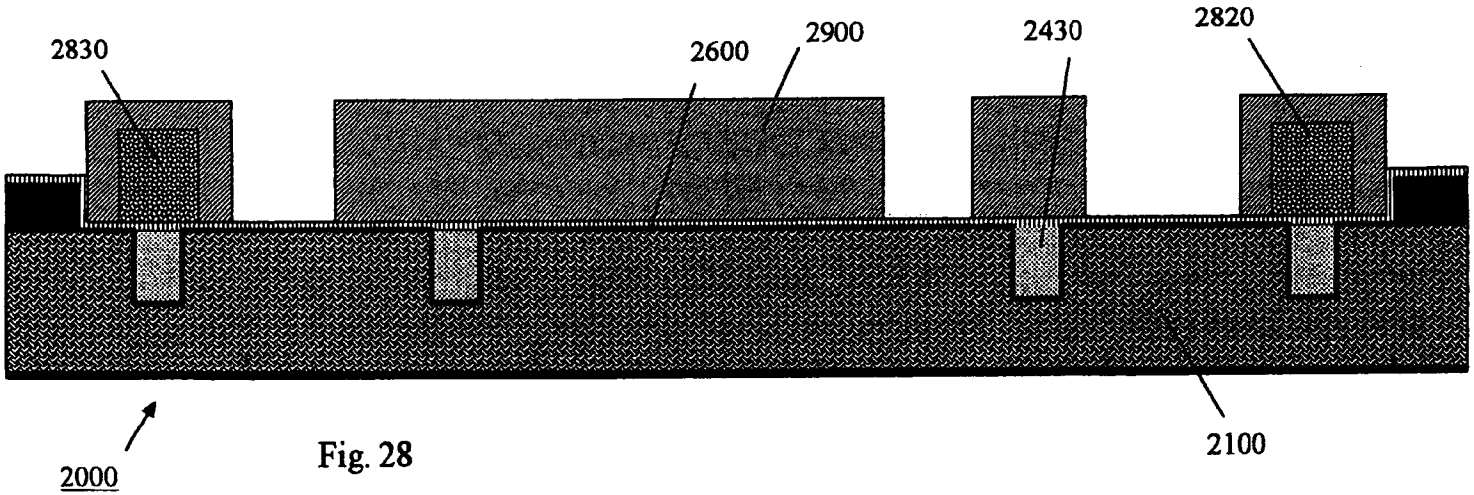
FIG. 28 is a cross sectional view of the exemplary substrate of FIG. 27 after deposition of photoresist.
Figure 29:
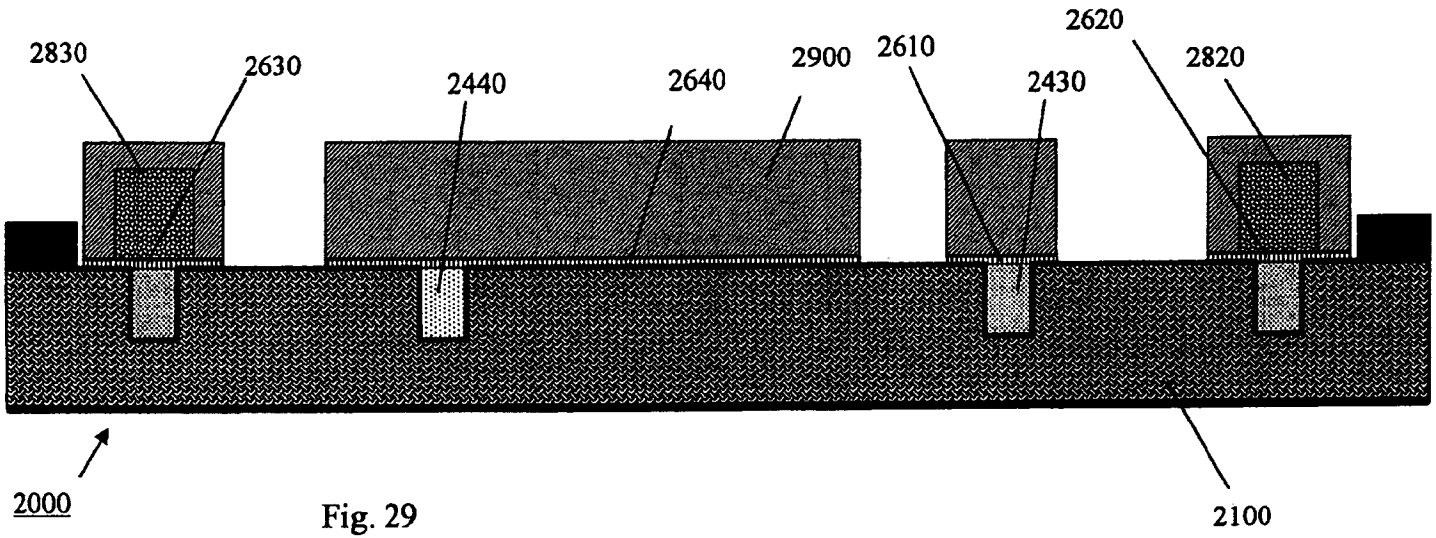
FIG. 29 is a cross sectional view of the exemplary substrate of FIG. 28 after etching the seed layer.

After plating, the photoresist layer 2700 may be stripped from the substrate, as shown in FIG. 27. Another layer of photoresist 2900 may then be deposited over the surface and patterned as shown in FIG. 28. This photoresist pattern is used to form the isolated metallization contact pads 2610-2610 from the continuous metallization layer 2600. Accordingly, metallization layer 2600 is milled away everywhere it is not protected by photoresist 2700, by, for example, ion milling, as shown in FIG. 29. The photoresist layer 2900 is then stripped from the surface of the substrate 2100, as shown in FIG. 30, leaving pads 2610-2640.

Figure 30:
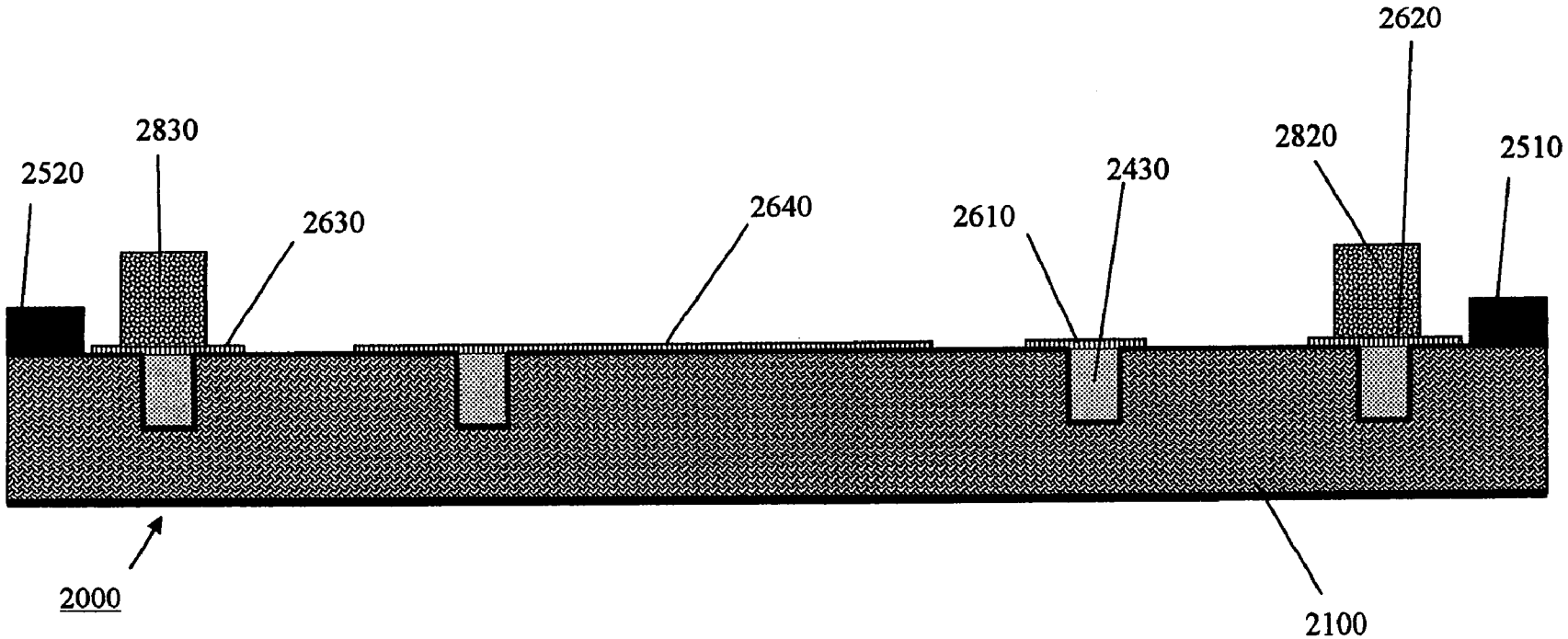
FIG. 30 is a cross sectional view of the exemplary substrate of FIG. 29 after removal of the photoresist.

The ion milling step leaves pad 2610 in the area shown in FIG. 30 for the contacts of the MEMS switch As discussed previously, there may be a second contact pad 2610' directly behind contact pad 2610, which may serve as the output contact of the switch 100. Pad 2620 is formed in the area under the right-side plated indium layer 2820 as a redundant electrical ground. Pad 2630 is formed in the area under the left-side plated indium layer 2830, and may provide electrical access to one plate of the parallel plate capacitor (the cantilevered beam) through the gold/indium bond to be formed when bonding the cantilevered beam portion 1000 to the electrical contacts portion 2000. Pad 2640 is formed in the area which will be directly beneath the cantilevered beam 1310, and this pad will form the other plate of the parallel plate capacitor which will exert the electrostatic force on the cantilevered beam 1310.

It may be important for metallization pads 2620 and 2630 to be wider in extent than the plated indium layers 2820 and 2830. The excess area may allow the indium to flow outward somewhat upon melting, without escaping the bond region, while simultaneously providing for the necessary Au/In ratios cited above.

Figure 31:
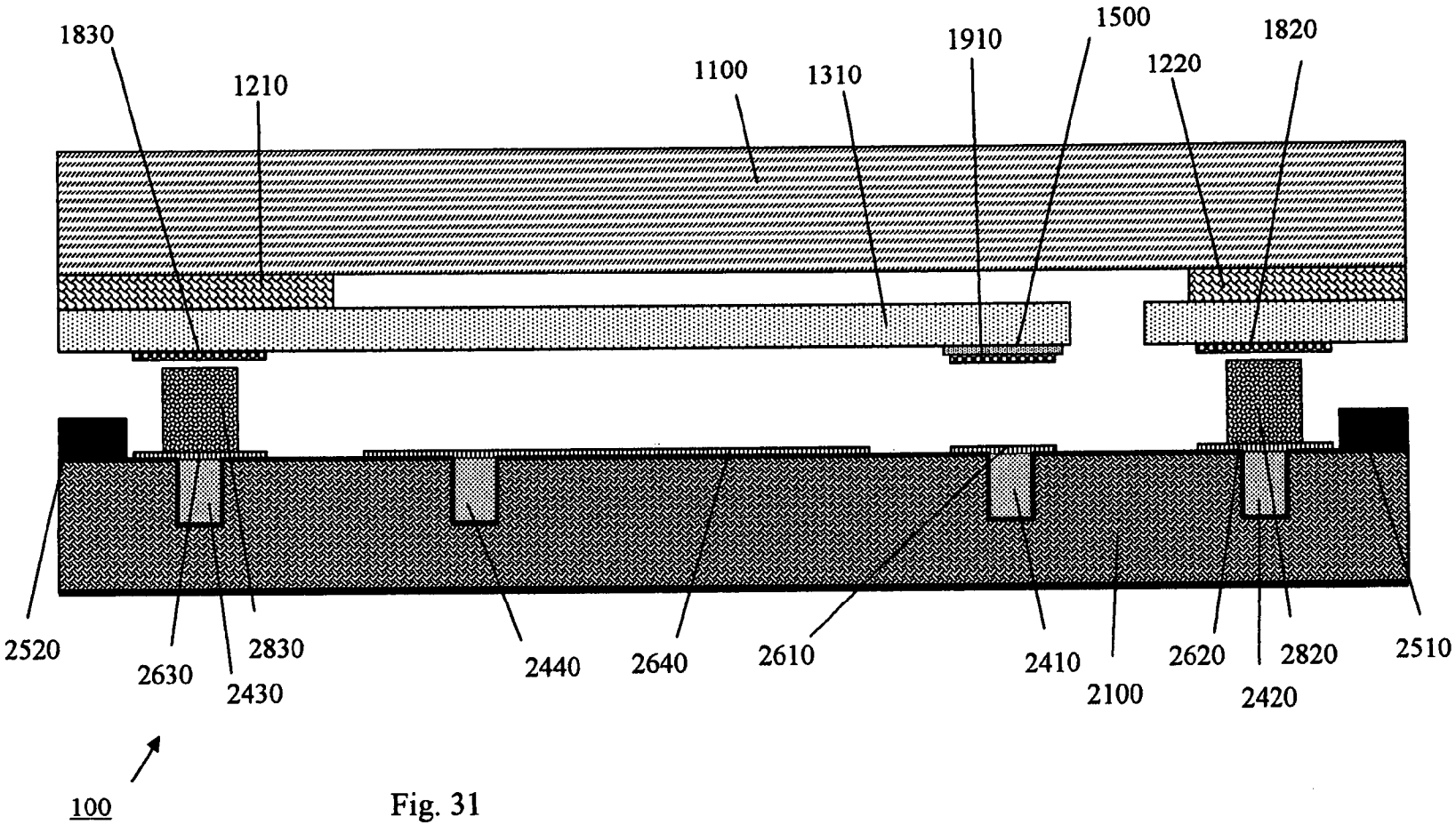
FIG. 31 is a cross sectional view of the dual substrates before bonding.

The two portions, the cantilevered beam portion 1000 and the electrical contacts portion 2000 are now ready to be assembled to form the dual substrate electrostatic MEMS switch 100. The two portions may be first aligned as shown in FIG. 31, such that the metallization layers 1820 and 1830 of the cantilevered portion 1000 are registered with the metallization layers 2620 and 2630, respectively. This places the plated indium layer 2820 between metallization layers 2620 and 1820, and plated indium layer 2830 between metallization layers 2630 and 1830.

Methods and techniques for forming the alloy seal are further described in U.S. patent application Ser. No. 11/211, 625, which is incorporated by reference herein in its entirety.

For MEMS switches that benefit from a defined ambient environment, the two portions 1000 and 2000 of the electrostatic MEMS switch 100 may first be placed in a chamber which is evacuated and then filled with the desired gas. For example, for MEMS switches to be used in telephone applications using relatively high voltage signals, the desired gas may be an insulating gas such as sulfur hexafluoride ($SF_6$) or a freon such as $CCl_2F_2$ or $C_2Cl_2F_4$. The insulating gas is then sealed within the dual substrate electrostatic MEMS switch 100 by sealing the cantilever portion 1000 to the electrical contacts portion 2000 with the alloy bond formed by layers 2620, 2820 and 1820 and layers 2630, 2830 and 1830.

To form the alloy bond between layers 2620, 2820 and 1820 and layers 2630, 2830 and 1830, the cantilevered portion 1000 may be applied to the electrical contacts portion 2000 under pressure and at elevated temperature. For example, the pressure applied between the cantilevered portion 1000 and the electrical contacts portion 2000 may be from 0.5 to 2.0 atmospheres, and at an elevated temperature of about 180 degrees centigrade. This temperature exceeds the melting point of the indium (157 degrees centigrade), such that the indium flows into and forms an alloy with the gold. As mentioned above, the stoichiometry of the alloy may be 2 indium atoms per one gold atom, to form $AuIn_2$. In contrast to the low melting point of the indium metal, the melting point of the alloy is 541 degrees centigrade. Therefore, although the alloy is formed at a relatively low temperature, the durability of the alloy bond is outstanding even at several hundred degrees centigrade. The bond is therefore compatible with processes which deposit vulnerable materials, such as metals, on the surfaces and in the devices. These vulnerable materials may not be able to survive temperatures in excess of about 200 degrees centigrade, without volatilizing or evaporating.

Upon exceeding the melting point of the indium, the indium layers 2820 and 2830 flow outward, and the cantilevered portion 1000 and the electrical contacts portion 2000 are pushed together, until their approach is stopped by the polymer standoffs 2510 and 2520. As the alloy forms, it may immediately solidify, sealing the $SF_6$ environment in the dual substrate electrostatic MEMS switch 100.

While the systems and methods described here use a gold/indium alloy to seal the MEMS switch, it should be understood that the dual substrate electrostatic MEMS switch 100 may use any of a number of alternative sealing methodologies, including different constituent metals for the bond line and cross-linked polymers. For example, the seal may also be formed using a low-outgassing epoxy which is impermeable to the insulating gas.

Figure 32:
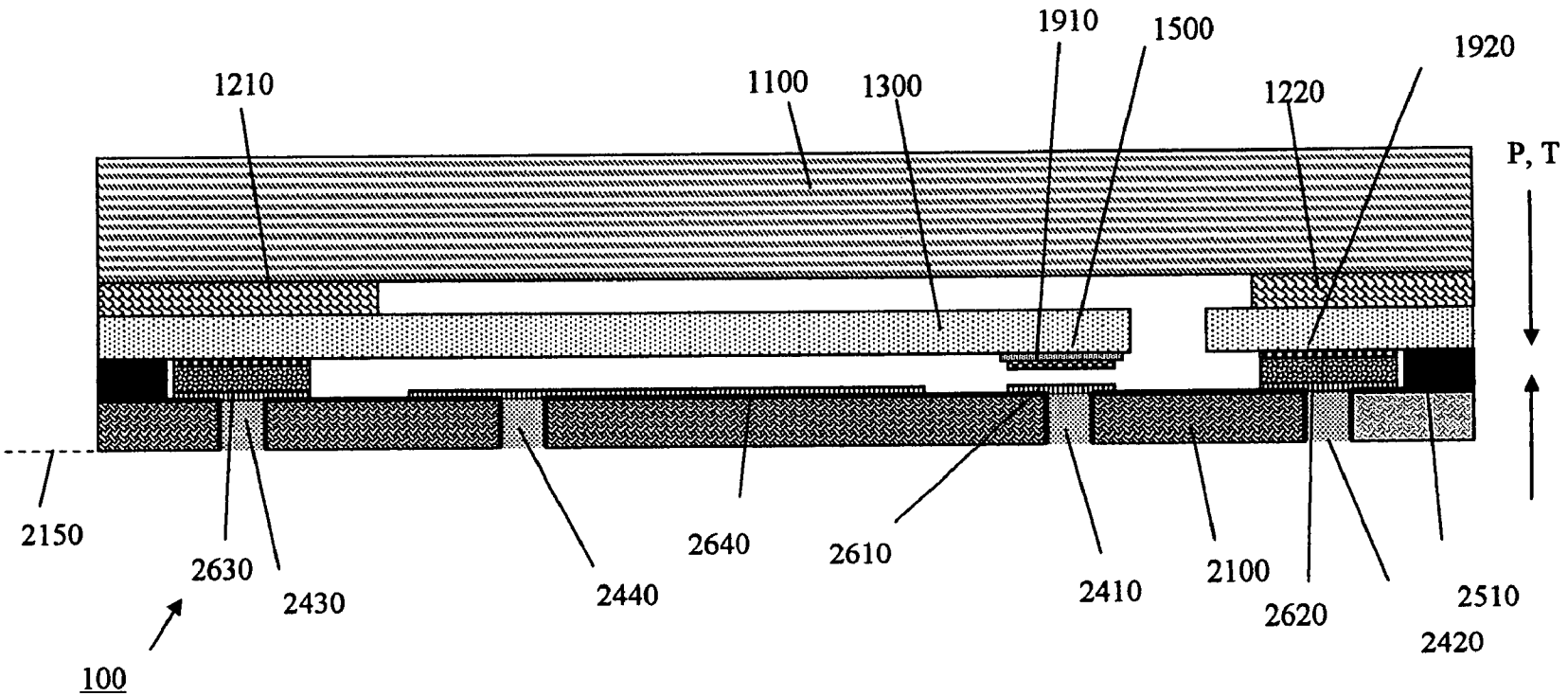
FIG. 32 is a cross sectional view of the dual substrate electrostatic MEMS switch after bonding.

FIG. 32 shows the dual substrate electrostatic MEMS switch 100 after assembly with the alloy bond. In its assembled state, the shunt bar 1910 on the cantilevered beam 1310 overhangs the electrical contacts 2610 and 2610', and the cantilevered beam 1310 overhangs the metallization plate 2640, as shown in FIG. 1. Upon applying appropriate voltages to metallization pads 2630 and 2640, a differential voltage forms across the parallel plate capacitor formed by the cantilevered beam 1310 and the metallization plate 2640, drawing the cantilevered beam 1310 toward the electrostatic metallization plate 2640. At it lower point of travel of the cantilevered beam 1310, the shunt bar 1910 affixed to the end of the cantilevered beam 1310 is applied across the electrical contacts 2610 and 2610' of the switch 100, thereby closing the switch. An input electrical signal applied to one of the electrical contacts 2610 or 2610' may then be obtained as an output electrical signal from the other electrical contact. The switch may be opened by discontinuing the voltages applied to the metallization pads 2630 and 2640, whereupon the switch may return to its original position because of the restoring spring force acting on the stiff beam, for example.

In order to apply the appropriate signals to metallization pads 2610, 2620, 2630 and 2640, electrical access may need to be achieved to vias 2410, 2420, 2430 and 2440. To provide access the vias, material from the backside of substrate 2100 may be removed until the dead-end walls of the blind trenches 2110-2140 have been removed, up to the level indicated by reference number 2150, as shown in FIG. 32. The technique for removing the excess material may be, for example, grinding.

Figure 33:
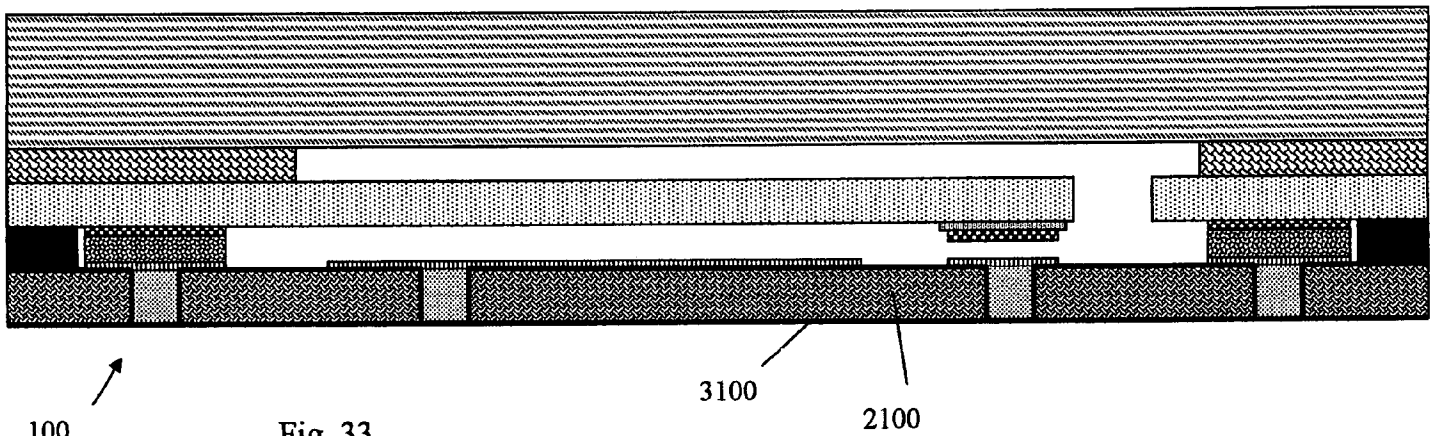
FIG. 33 is a cross sectional view of the dual substrate MEMS switch after sputtering the isolation oxide on the underside of the dual substrate MEMS switch.
Figure 34:
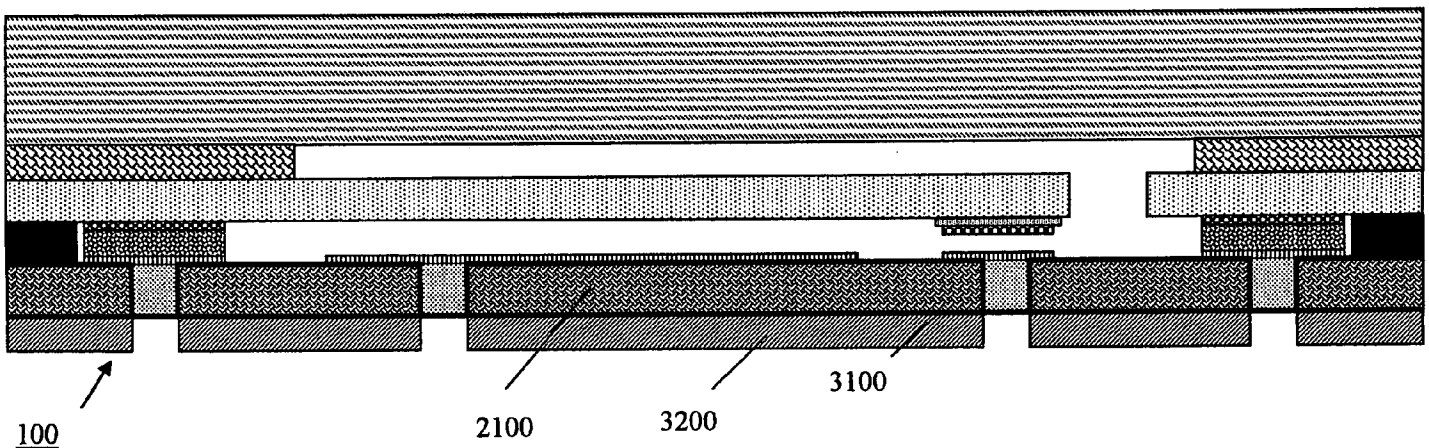
FIG. 34 is a cross sectional view of the dual substrate MEMS switch after depositing photoresist over the isolation layer.
Figure 35:
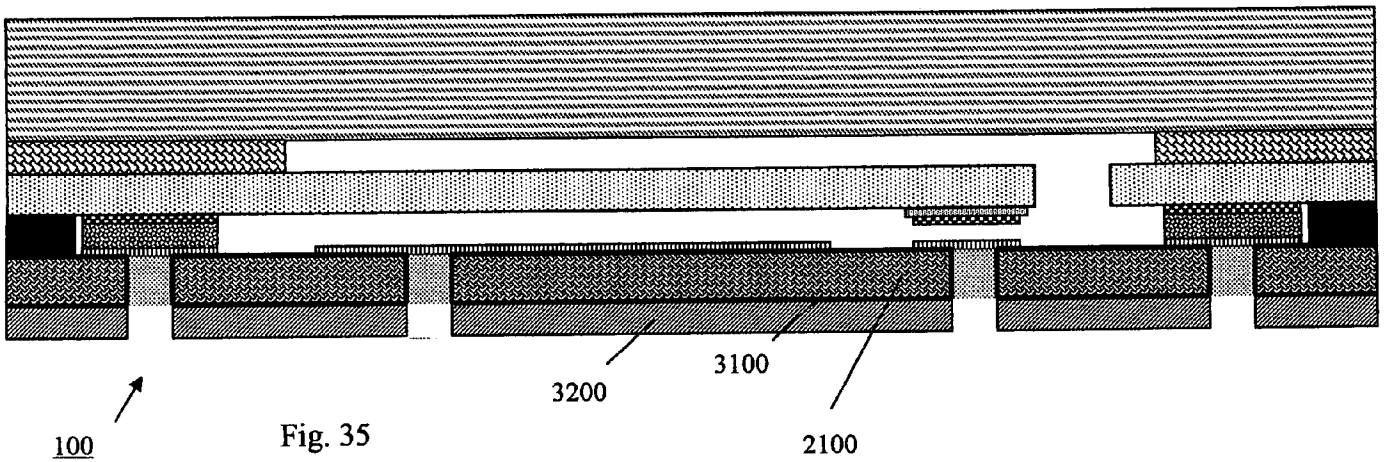
FIG. 35 is a cross sectional view of the dual substrate MEMS switch after etching the oxide layer from the vias.
Figure 36:
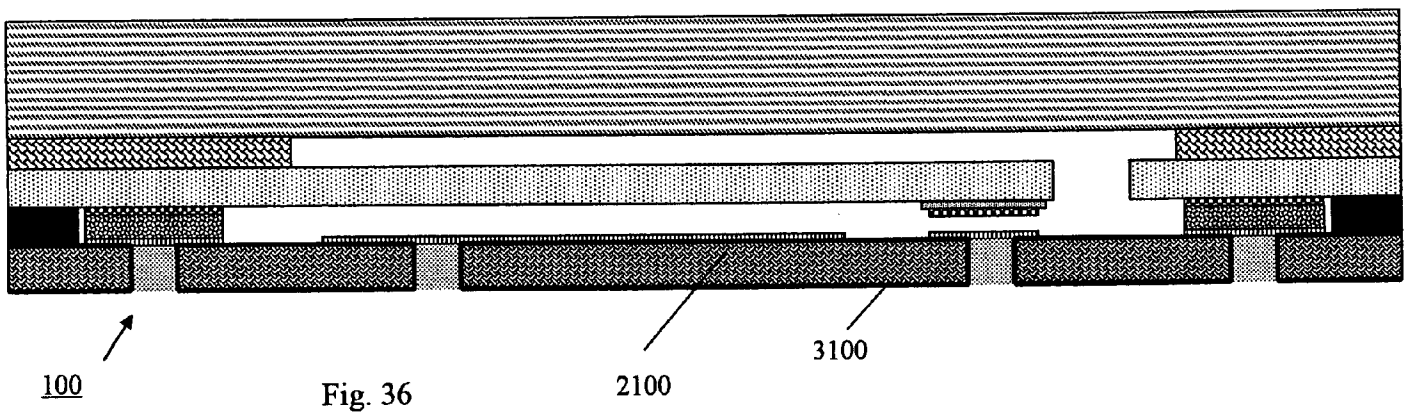
FIG. 36 is a cross sectional view of the dual substrate MEMS switch after removing the photoresist from the substrate.
Figure 37:
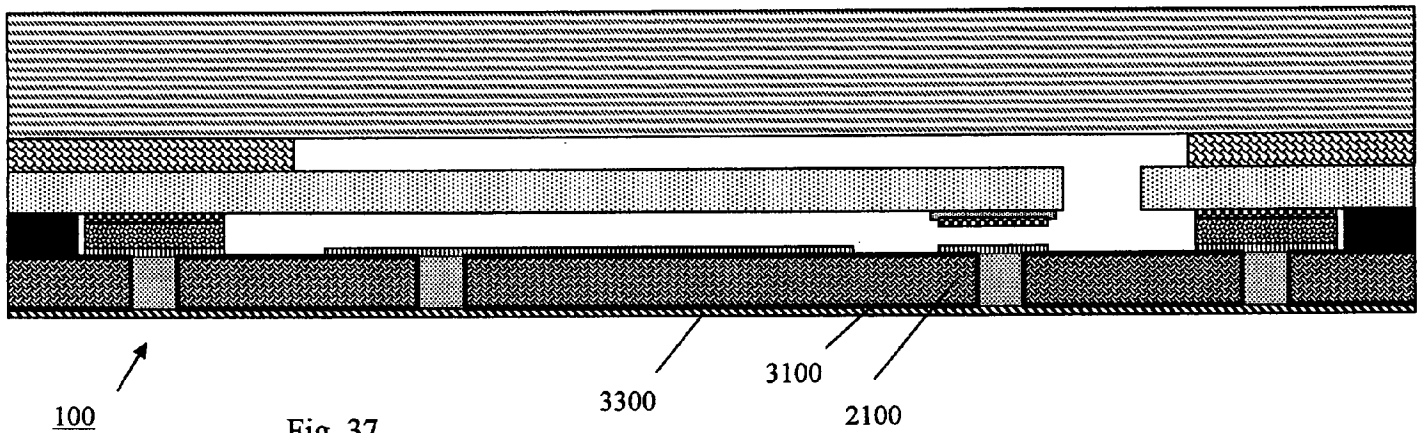
FIG. 37 is a cross sectional view of the dual substrate MEMS switch after depositing the conductive layer on the underside of the dual substrate MEMS switch.
Figure 38:
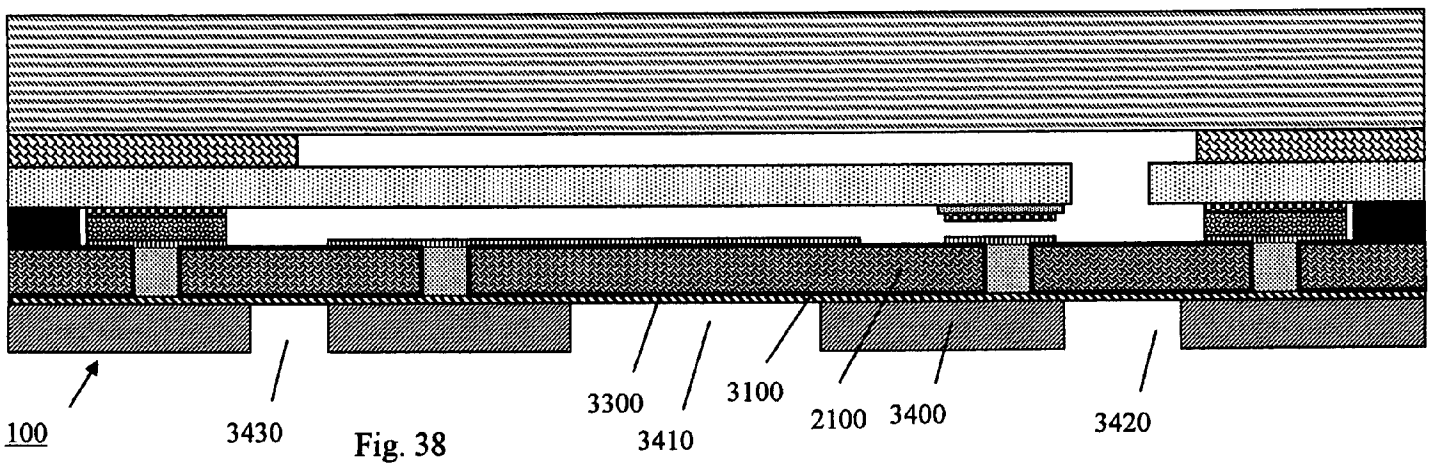
FIG. 38 is a cross sectional view of the dual substrate MEMS switch after depositing and patterning photoresist over the conductive layer.
Figure 39:
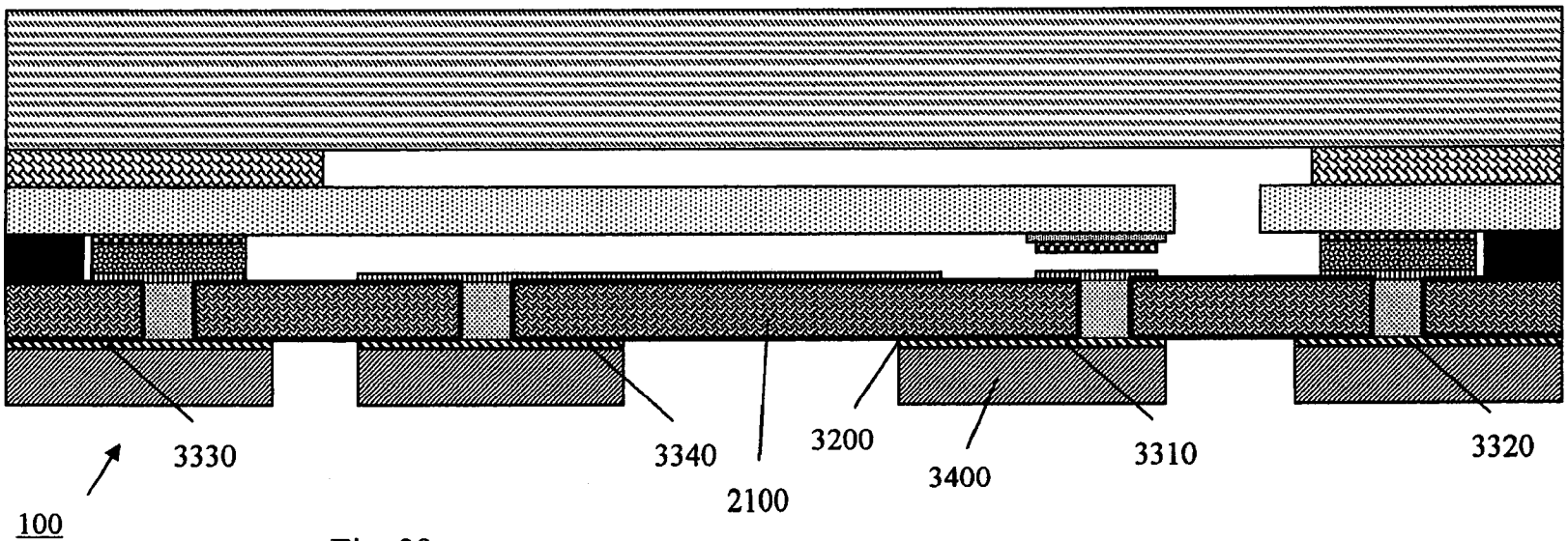
FIG. 39 is a cross sectional view of the dual substrate MEMS switch after etching the conductive layer according to the photoresist pattern.

The lower substrate 2100 may then be coated with an oxide 3100, which may be $SiO_2$, for example, at a thickness sufficient to isolate the vias 2410-2440 one from the other, as shown in FIG. 33. The oxide may be deposited by a low temperature dielectric deposition process, such as sputtering or plasma enhanced chemical vapor deposition (PECVD). The oxide-coated substrate 2100 may then be covered with photoresist 3200 and patterned, as shown in FIG. 34. The substrate 2100 may then be etched through the photoresist 3200 to remove the oxide 3100 from the openings of the vias 2410-2440. The substrate 2100 is shown in FIG. 35. The photoresist 3200 may then be stripped from the substrate 2100, as shown in FIG. 36.

The rear surface of substrate 2100 may then be covered with a conductive layer 3300. In some exemplary embodiments, the conductive layer may be a Cr/Mo/Au multilayer, chosen for the same reasons as multilayers 1900 and 2600, and deposited using the same or similar techniques. Alternatively, the conductive layer 3300 may be any conductive material having acceptable electrical and/or thermal transport characteristics.

The conductive layer 3300 is then covered once more with photoresist 3400, which is also patterned with openings 3410, 3420 and 3430, which correspond to the locations of the contact pads to be formed from the conductive layer 3300. Alternatively, the metal may be deposited through a shadow mask, allowing for the possibility of thicker layers and eliminating the need for further processing.

The conductive layer 3300 on the rear ofthe substrate 2100 is then etched to remove the conductive layer at the openings of the photoresist 3410, 3420 and 3430, to form isolated conductive pads 3310, 3320, 3330 and 3340. Conductive pad 3310 may provide electrical access to the contact point 2610 of the switch; conductive pad 3320 may provide a redundant ground connection to the SOI device layer; conductive pad 3330 may provide electrical access to the cantilevered beam 1310 through via 2630 and metal alloy bond 2830; and conductive pad 3340 may provide electrical access to the electrostatic plate 2640.

Figure 40:
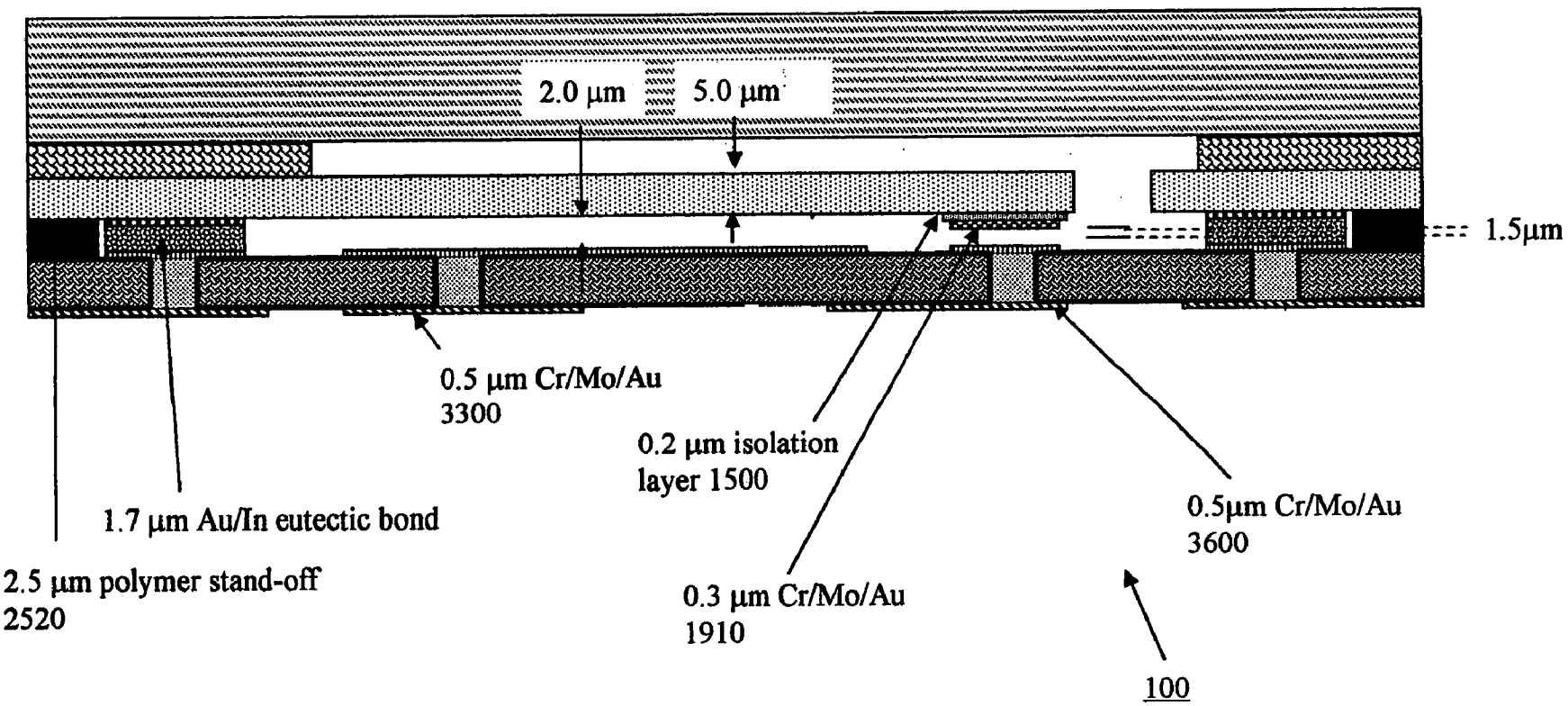
FIG. 40 is a cross sectional view of the finished dual substrate MEMS switch.

Exemplary thicknesses of various layers of the dual substrate electrostatic MEMS switch 100 are shown in FIG. 40. As shown in FIG. 40, an exemplary thickness of the Cr/Mo/Au conductive layer 3600 is about 0.5 μm An exemplary distance between the lower surface of the shunt bar 1910 and the upper surface of the contact point 2610, also defined as the throw of the switch, may be, for example, about 1.5 μm An exemplary thickness of the conductive material of the shunt bar 1910 may be, for example, about 0.3 μm An exemplary thickness of the alloy bond (In material as well as Cr/Mo/Au multilayers) may be about 1.7 μm An exemplary thickness of the cantilevered beam 1310 may be about 5.0 μm, which may also be the thickness of the device layer 1300. An exemplary thickness of the isolation layer 1500 may be 0.2 μm Finally, an exemplary thickness of the polymer standoff 2520 may be about 2.5 μm, which also defines the separation between the cantilevered portion 1000 and the electrical contacts portion 2000, of the dual substrate electrostatic MEMS switch 100.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. For example, while the disclosure describes a number of fabrication steps and exemplary thicknesses for the layers included in the MEMS switch, it should be understood that these details are exemplary only, and that the systems and methods disclosed here may be applied to any number of alternative MEMS or non-MEMS devices. Accordingly, the exemplary implementations set forth above, are intended to be illustrative, not limiting.

What is claimed is:

1. An electrostatic MEMS switch, comprising:

a monolithic cantilevered beam formed on a first substrate;

an electrostatic plate disposed adjacent to the monolithic cantilevered beam;

at least one electrical contact formed on a second substrate; and a hermetic seal which couples the first substrate to the second substrate, and seals the MEMS switch, wherein an electrostatic force is generated between the monolithic cantilevered beam and the electrostatic plate; and at least one electrical via formed through a thickness of the second substrate, and wherein the hermetic seal provides an electrical connection between the at least one electrical via and the monolithic cantilevered beam.

2. The electrostatic MEMS switch of claim 1, wherein the first substrate is a silicon-on-insulator substrate including a device layer, a handle wafer and an insulating oxide layer between the device layer and the handle wafer, and the second substrate is at least one of a silicon substrate and a silicon-on-insulator substrate.

3. The electrostatic MEMS switch of claim 1, wherein the at least one monolithic cantilevered beam comprises a portion of a silicon device layer of a silicon-on-insulator substrate.

4. The electrostatic MEMS switch of claim 3, wherein the electrostatic plate and the electrical contacts comprise a multilayer film including:

1) an adhesion layer of chromium;

2) a barrier layer of molybdenum; and 3) a metallization layer of gold.

5. The electrostatic MEMS switch of claim 3, wherein the hermetic seal comprises:

an alloy of gold and indium which bonds the first substrate to the second substrate.

6. The electrostatic MEMS switch of claim 2, wherein the monolithic cantilevered beam is formed from the device layer of the silicon-on-insulator substrate, and affixed to the handle wafer of the silicon-on-insulator substrate by the insulating oxide layer.

7. The electrostatic MEMS switch of claim 1, further comprising a shunt bar coupled to the monolithic cantilevered beam, which electrically connects two electrical contacts formed on the second substrate when the electrostatic MEMS switch is closed, wherein the shunt bar is electrically isolated from other portions of the monolithic cantilevered beam.

8. A method of operating the electrostatic MEMS switch of claim 7, comprising:

applying a first voltage to the monolithic cantilevered beam formed on the first substrate;

applying a second voltage to an electrostatic plate formed on the second substrate;

forming an electrical connection between the two electrical contacts by bending the monolithic cantilevered beam and shunt bar toward the electrical contacts in response to the applied voltages.

9. The method of claim 8, further comprising:

applying an input signal to one of the contacts formed on the second substrate; and obtaining an output signal from the other electrical contact formed on the second substrate.

10. The method of claim 8, further comprising:

removing the first voltage applied to the monolithic cantilevered beam; and removing the second voltage applied to the electrostatic plate to open the electrostatic MEMS switch.

11. An apparatus for manufacturing an electrostatic MEMS switch, comprising:

means for forming a monolithic cantilevered beam on a first substrate;

means for forming an electrostatic plate adjacent to the monolithic cantilevered beam;

means for forming at least one electrical contact on a second substrate;

means for coupling the first substrate to the second substrate with a hermetic seal that seals the MEMS switch, wherein an electrostatic force is generated between the monolithic cantilevered beam and the electrostatic plate; and means for forming at least one electrical via through a thickness of the second substrate, and wherein the hermetic seal provides an electrical connection between the at least one electrical via and the monolithic cantilevered beam.

12. A method for manufacturing an electrostatic MEMS switch, comprising:

forming a monolithic cantilevered beam on a first substrate;

forming an electrostatic plate adjacent to the monolithic cantilevered beam;

forming at least one electrical contact on a second substrate;

coupling the first substrate to the second substrate with a hermetic seal that seals the MEMS switch, wherein an electrostatic force is generated between the monolithic cantilevered beam and the electrostatic plate; and forming at least one electrical via through a thickness of the second substrate, wherein the hermetic seal provides an electrical connection between the at least one electrical via and the monolithic cantilevered beam.

13. The method of claim 12, wherein the hermetic seal comprises an alloy of gold and indium.

14. The method of claim 13, wherein forming the electrostatic plate and the at least one electrical contact further comprises:

depositing an adhesion layer over the second substrate;

depositing a barrier layer over the adhesion layer; and depositing a metallization layer over the barrier layer.

15. The method of claim 12, further comprising:

forming electrical vias through a thickness of the second substrate.

16. The method of claim 15, wherein forming the electrical vias comprises:

forming at least one blind hole on a front side of the second substrate;

forming a seed layer in the at least one blind hole;

depositing a conductive material onto the seed layer; and removing material from a rear side of the second substrate to remove a dead-end wall of the at least one blind hole.

17. The method of claim 16, wherein depositing a conductive material onto the seed layer comprises plating copper onto the seed layer.

18. The method of claim 12, wherein coupling the first substrate to the second substrate with a hermetic seal comprises:

depositing a first metal on the first substrate; and depositing a second metal on the second substrate; and coupling the first substrate to the second substrate by heating the first substrate and the second substrate to at least a melting point of at least one of the first metal and the second metal.

19. The method of claim 12, wherein the first substrate comprises a silicon-on-insulator substrate, and the second substrate comprises at least one of a silicon wafer and a silicon-on-insulator substrate.

20. The method of claim 19, wherein forming the monolithic cantilevered beam on the first substrate comprises:

etching an outline of the monolithic cantilevered beam in a device layer of the silicon-on-insulator substrate;

releasing the monolithic cantilevered beam from a handle wafer of the silicon-on-insulator substrate by etching an oxide layer between the device layer and the handle wafer.

* * * * *